US012303091B2

(12) United States Patent
Doughty et al.

(10) Patent No.: US 12,303,091 B2
(45) Date of Patent: May 20, 2025

(54) PAD CHANGING SYSTEM FOR ROBOTIC VACUUM CLEANERS

(71) Applicant: iRobot Corporation, Bedford, MA (US)

(72) Inventors: Brian W. Doughty, Framingham, MA (US); Isaac Fowler, Boston, MA (US); Leo Torrente, Somerville, MA (US); Vincent Andrew Wolff, Norfolk, MA (US)

(73) Assignee: iRobot Corporation, Bedford, MA (US)

( * ) Notice: Subject to any disclaimer, the term of this patent is extended or adjusted under 35 U.S.C. 154(b) by 0 days.

(21) Appl. No.: 17/744,285

(22) Filed: May 13, 2022

(65) Prior Publication Data

US 2022/0386834 A1 Dec. 8, 2022

Related U.S. Application Data

(60) Provisional application No. 63/195,794, filed on Jun. 2, 2021.

(51) Int. Cl.

| | |
|---|---|
| ***A47L 9/00*** | (2006.01) |
| ***A47L 9/06*** | (2006.01) |
| ***A47L 9/28*** | (2006.01) |

(52) U.S. Cl.

CPC ..... *A47L 9/0063* (2013.01); *A47L 9/0673* (2013.01); *A47L 9/2852* (2013.01); *A47L 9/2873* (2013.01); *A47L 2201/028* (2013.01); *A47L 2201/04* (2013.01)

(58) Field of Classification Search

CPC ..... A47L 2201/02; A47L 2201/028; A47L 2201/04; A47L 2201/06; A47L 9/2873; A47L 11/4091; A47L 11/24; A47L 11/28; A47L 11/40; A47L 11/4036; A47L 13/16

See application file for complete search history.

(56) References Cited

U.S. PATENT DOCUMENTS 5,778,631 A * 7/1998 Simmons ..... B65B 55/20 53/139.5
5,829,231 A * 11/1998 Harding ..... B65B 55/20 53/139.5

(Continued)

FOREIGN PATENT DOCUMENTS

| | | | | |
|---|---|---|---|---|
| CN | 112741561 A * | 5/2021 | ..... | A47L 11/28 |
| EP | 2303085 | 4/2011 | | |
| KR | 20130120554 | 11/2013 | | |

(Continued)

OTHER PUBLICATIONS

English translation of WO2020125774A1 (Year: 2020).*

(Continued)

*Primary Examiner* — David S Posigian
*Assistant Examiner* — Sukwoo James Chang
(74) *Attorney, Agent, or Firm* — Schwegman Lundberg & Woessner, P.A.

(57) ABSTRACT

A docking station for a mobile cleaning robot can include a housing. The housing can define or comprise a pad receptacle and a pad dispenser. The pad receptacle can be configured to receive a soiled pad from a pad tray of the mobile cleaning robot. The pad dispenser can be configured to provide a fresh pad to the pad tray of the mobile cleaning robot.

20 Claims, 24 Drawing Sheets

(56) References Cited

U.S. PATENT DOCUMENTS

| | | | | |
|---|---|---|---|---|
| 2015/0182094 | A1* | 7/2015 | Brain | A47L 13/42 15/119.1 |
| 2015/0259178 | A1* | 9/2015 | Rosenbaum | A47L 25/00 15/210.1 |

FOREIGN PATENT DOCUMENTS

| | | | | |
|---|---|---|---|---|
| WO | 2020125489 | | 6/2020 | |
| WO | WO2020125774 | A1 * | 6/2020 | A47L 11/28 |

OTHER PUBLICATIONS

Excerpt of Masoum et al., Chapter 8: Impact of Poor Power Quality on Reliability, Relaying and Security, Power Quality in Power Systems and Electrical Machines, 2nd Ed. (Year: 2015).*
English translation of CN112741561A (Year: 2021).*
Wayback Machine display of Dictionary.com definition "engage" (Year: 2021).*
"International Application Serial No. PCT US2022 029253, International Search Report mailed Jul. 22, 2022", 4 pgs.
"International Application Serial No. PCT US2022 029253, Written Opinion mailed Jul. 22, 2022", 7 pgs.
"International Application Serial No. PCT/US2022/029253, International Preliminary Report on Patentability mailed Dec. 14, 2023", 9 pgs.

* cited by examiner

PAD CHANGING SYSTEM FOR ROBOTIC VACUUM CLEANERS

CLAIM OF PRIORITY

This patent application claims the benefit of priority, under 35 U.S.C. Section 119(e), to Brian Doughty, U.S. Patent Application Ser. No. 63/195,794, entitled "PAD CHANGING SYSTEM FOR ROBOTIC VACUUM CLEANERS," filed on Jun. 2, 2021, which is hereby incorporated by reference herein in its entirety.

BACKGROUND

Autonomous mobile robots include autonomous mobile cleaning robots that can autonomously perform cleaning tasks within an environment, such as a home. Many kinds of cleaning robots are autonomous to some degree and in different ways. Some robots can perform vacuuming operations and some can perform mopping operations. Other robots can include components or systems to perform both vacuuming and mopping operations.

SUMMARY

Some autonomous cleaning robots can include both a vacuum system and a mopping system that can allow the robots to perform both mopping and vacuuming operations (such as simultaneously or alternatively), often referred to as two-in-one robots or vacuums. Some two-in-one robots include a pad type mopping system located rearward of a vacuum extractor that allows the robot to extract debris from a floor surface just prior to mopping the surface with the pad. These systems can be effective for cleaning hard surfaces that may require both debris extraction and mopping. However, use of a pad type mopping system often requires that a mopping pad be replaced one or more times during a cleaning mission, depending on the size of the area to be cleaned and how dirty the area is. Pad changing can also occur after the mission is complete, such as to prepare the robot ready for the next mission. While a user can replace the mopping pad of the mobile cleaning robot, a user interfacing with the mobile cleaning robot during missions can increase cleaning times.

This disclosure helps to address these issues by providing a mobile cleaning robot and docking station configured to autonomously replace a mopping pad of the mobile cleaning robot, before, during, or after a mopping mission. For example, the mobile cleaning robot can navigate to the docking station and discard a soiled or dirty mopping pad from a pad tray of the mobile cleaning robot in a pad receptacle. The mobile cleaning robot can then move to attach a fresh or clean mopping pad to the pad tray from a storage area containing clean pads (such as a pad dispenser) in or on the docking station. Such a system can help to reduce user interactions with a mopping robot or a two-in-one mobile cleaning robot, helping to increase robot autonomy. Such a system can also be used in mopping only robots.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
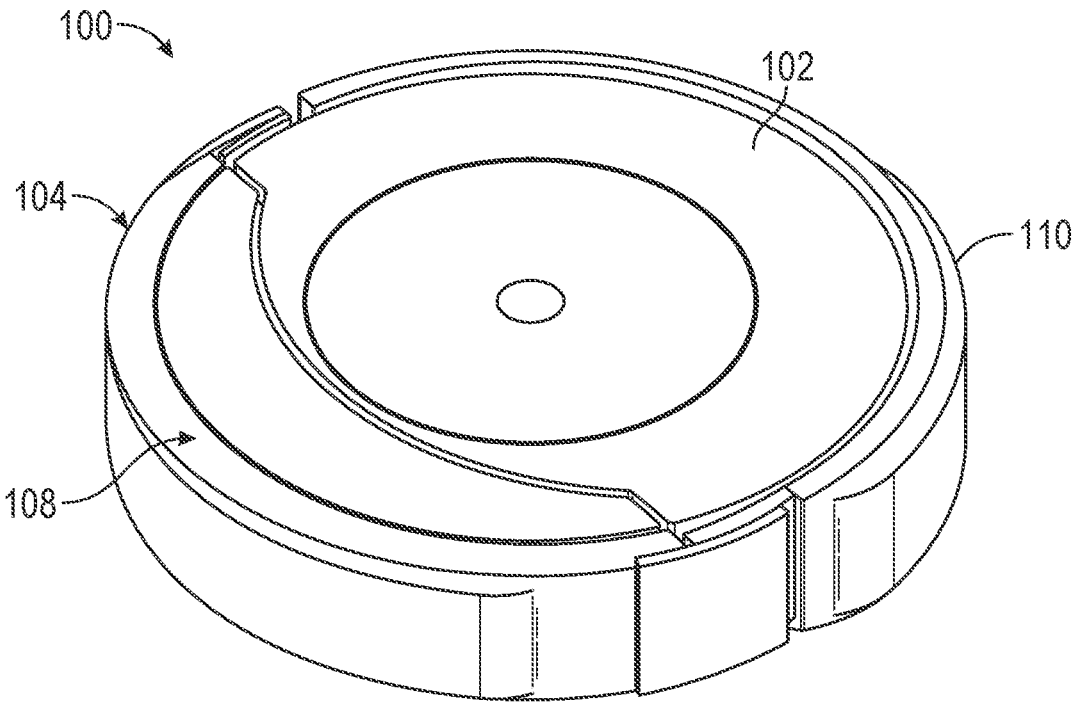
FIG. 1A illustrates an isometric view of a mobile cleaning robot in a first condition.
Figure 1B:
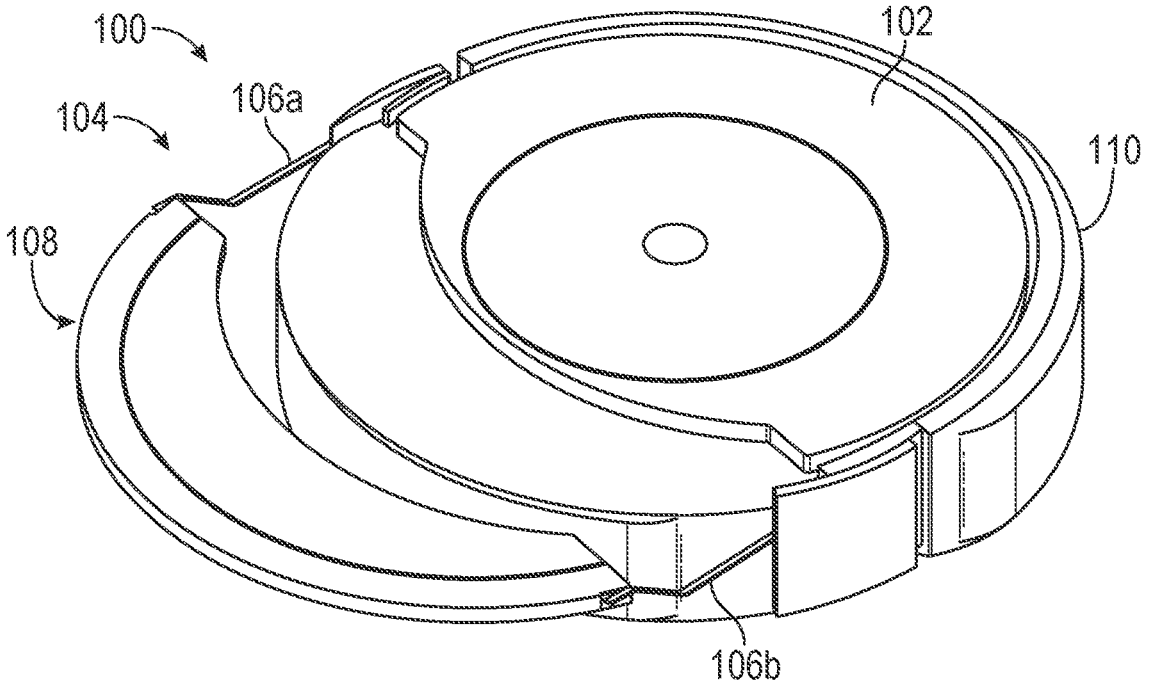
FIG. 1B illustrates an isometric view of a mobile cleaning robot in a second condition.
Figure 1C:
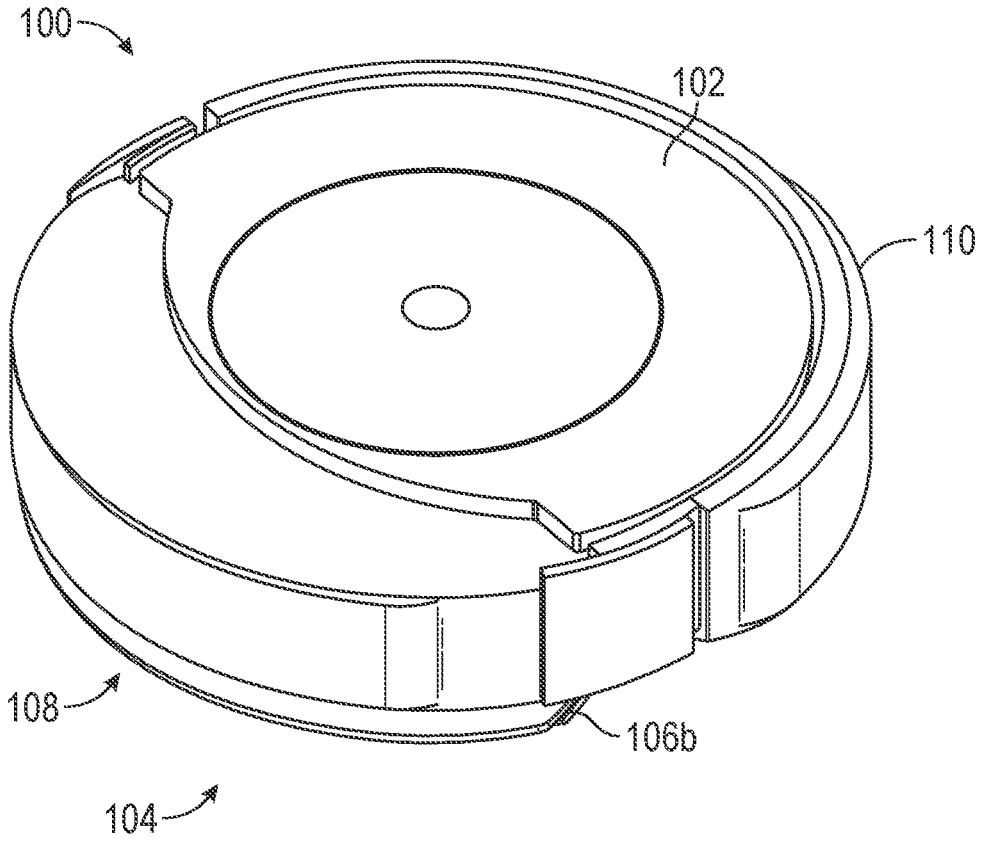
FIG. 1C illustrates an isometric view of a mobile cleaning robot in a third condition.

FIG. 1A illustrates an isometric view of a mobile cleaning robot 100 in a first condition. FIG. 1B illustrates an isometric view of the mobile cleaning robot 100 in a second condition. FIG. 1C illustrates an isometric view of the mobile cleaning robot 100 in a third condition. FIGS. 1A-1C also show orientation indicators Front and Rear. FIGS. 1A-1C are discussed together below.

The mobile cleaning robot 100 can include a body 102 and a mopping system 104. The mopping system 104 can include arms 106*a* and 106*b* (referred to together as arms 106) and a pad plate assembly 108. The robot 100 can also include a bumper 110 and other features such as an extractor (including rollers), one or more side brushes, a vacuum system, a controller, a drive system (e.g., motor, geartrain, and wheels), a caster, sensors, or the like, as shown in U.S. Patent Application Ser. No. 63/088,544, entitled "Two In One Mobile Cleaning Robot," filed on Oct. 7, 2020, to Michael G. Sack, which is incorporated by reference herein in its entirety. A proximal portion of the arms 106*a* and 106*b* can be connected to an internal drive system (such as shown and discussed in U.S. Patent Application Ser. No. 63/088,544). A distal portion of the arms 106 can be connected to the pad plate assembly 108.

In operation of some examples, the robot 100 can operate the arms 106 to move the pad plate assembly 108 between a stored position (shown in FIG. 1A), an extended position (shown in FIG. 1B), and an operating or cleaning position (shown in FIG. 1C). Optionally, the robot 100 can operate the arms 106 to move the pad plate assembly 108 in any position between the operating and stored positions. The robot 100 can optionally be stored in any position.

In the stored position, the robot 100 can perform vacuuming operations only. In the operating position, the robot can perform wet or dry mopping operations and vacuuming operations or can perform only mopping operations. In the extended position (and positions similar thereto), the robot 100 can change a mopping pad of the pad assembly, as discussed in further detail below.

Figure 2A:
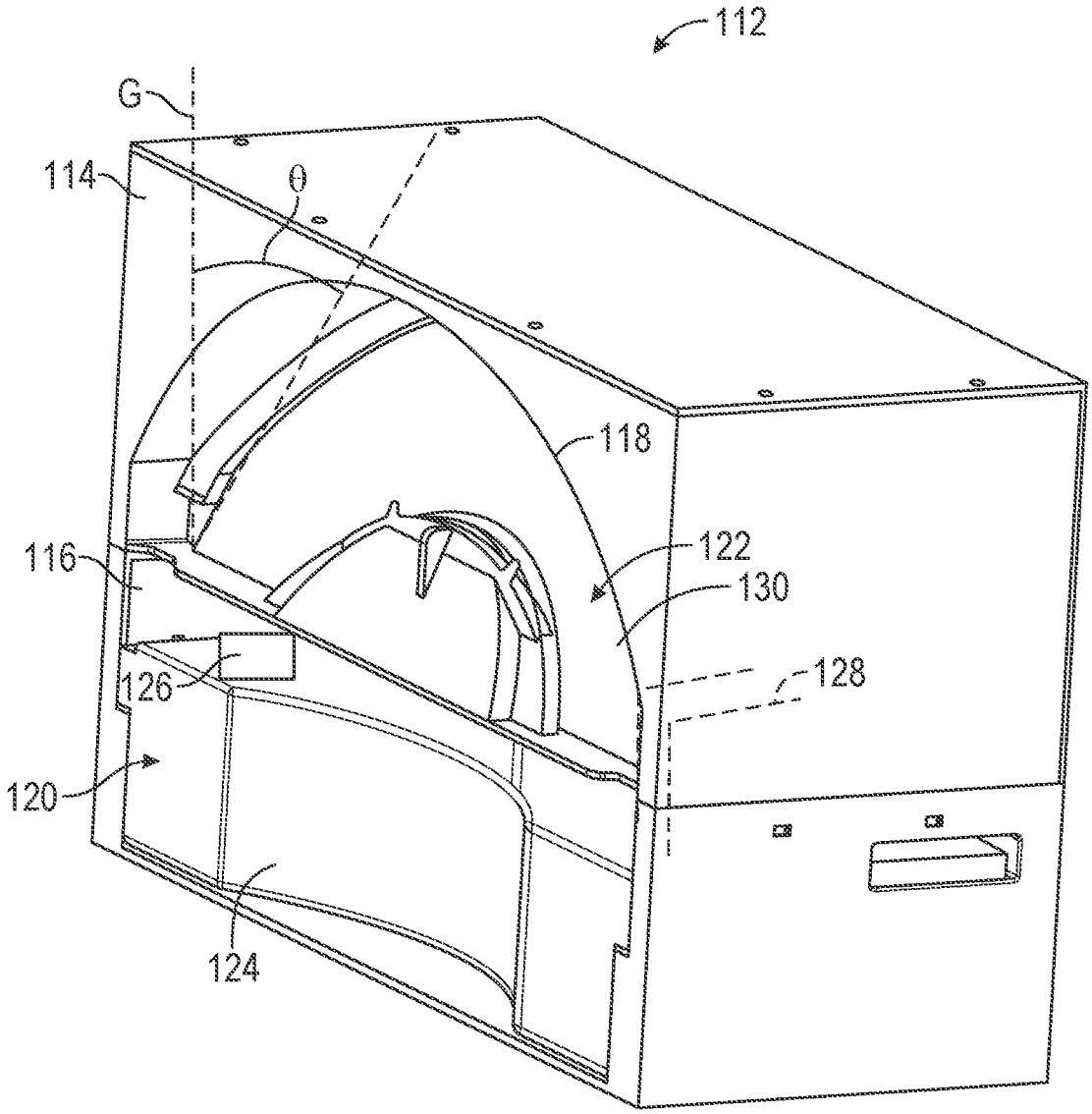
FIG. 2A illustrates a perspective view of a docking station.
Figure 2B:
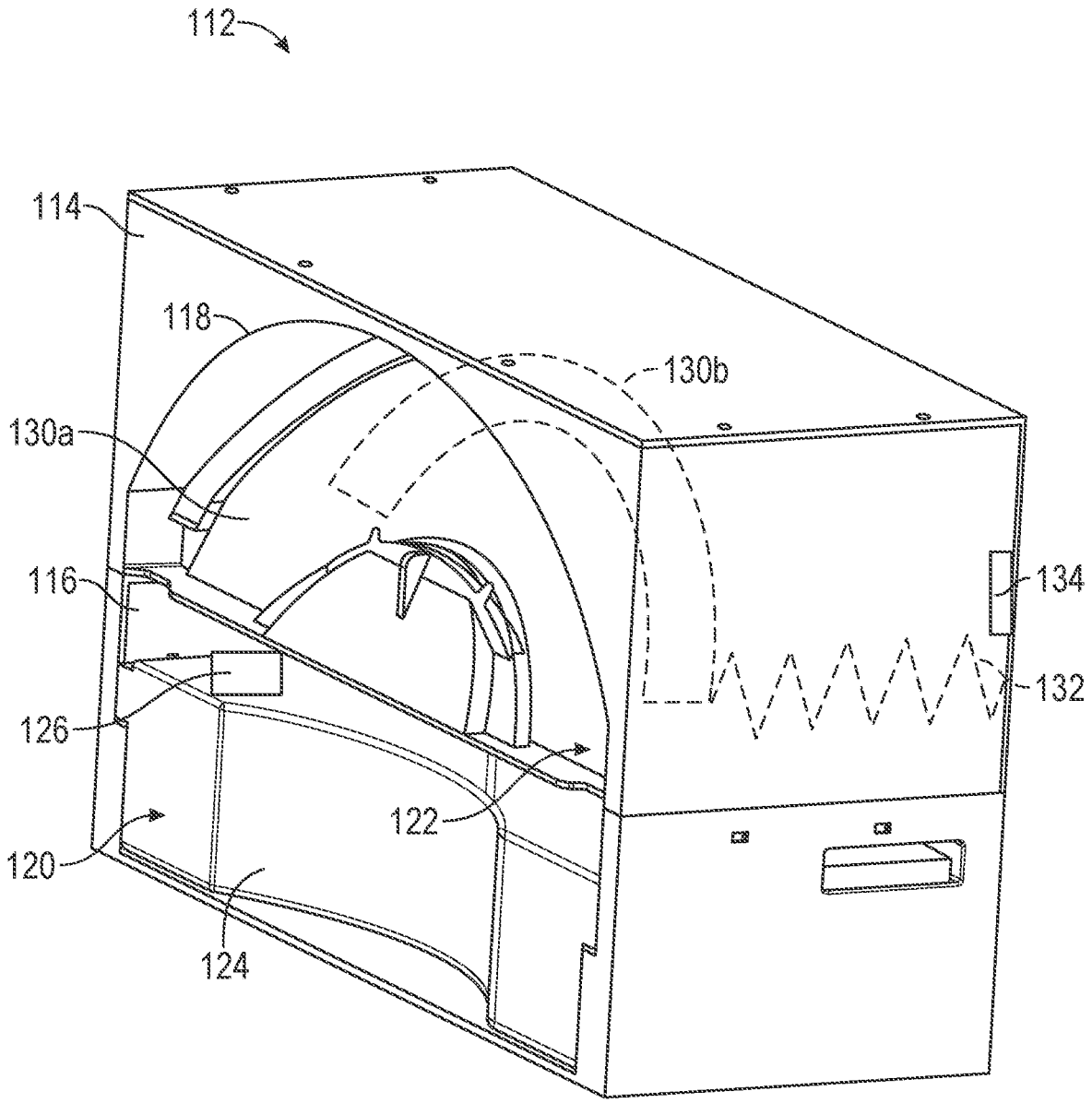
FIG. 2B illustrates a perspective view of a docking station.
Figure 2C:
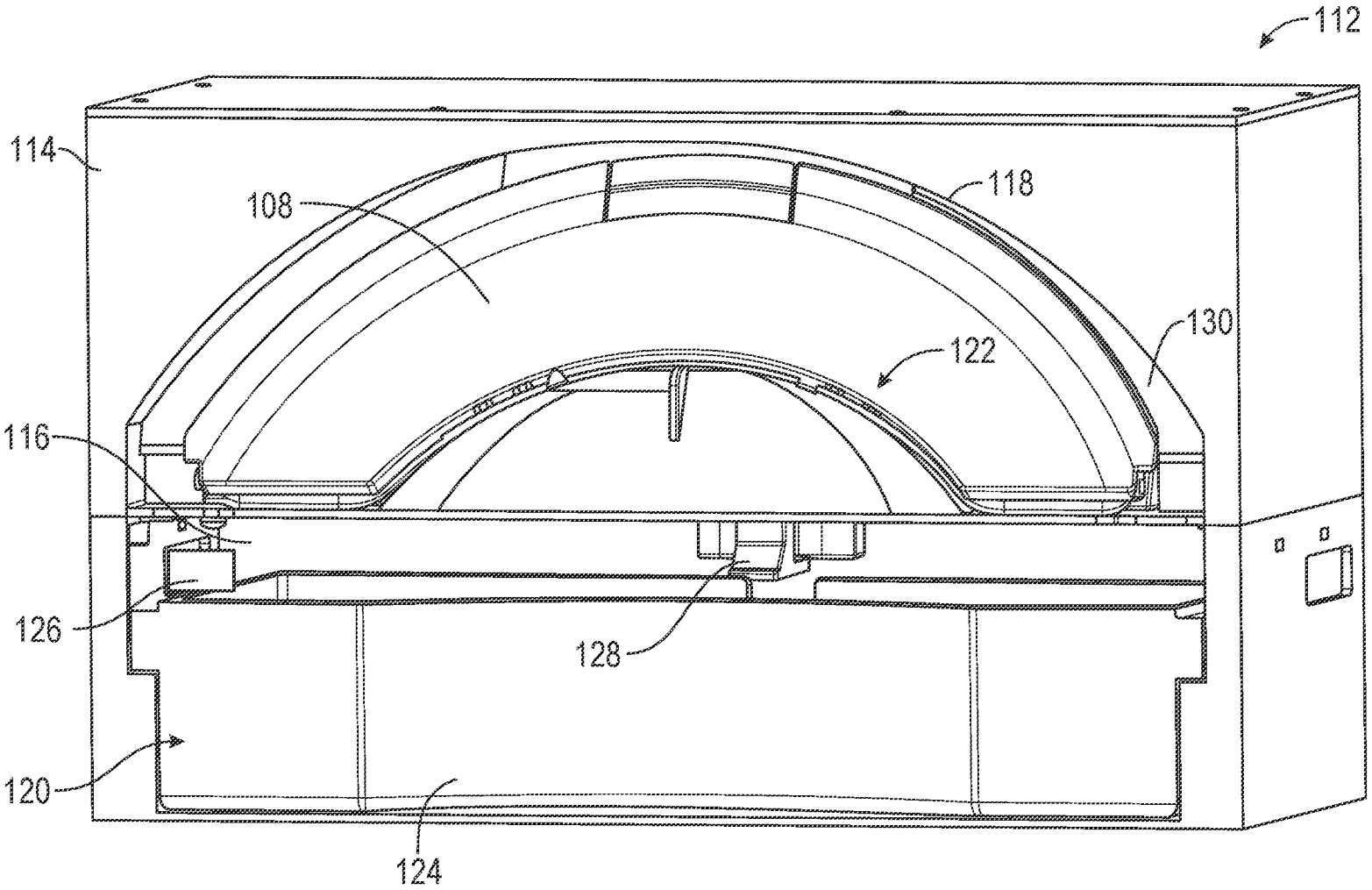
FIG. 2C illustrates a perspective view of a docking station.

FIG. 2A illustrates a perspective view of a docking station 112. FIG. 2B illustrates a perspective view of the docking station 112. FIG. 2C illustrates a perspective view of the docking station 112. FIGS. 2A-2C are discussed together below.

The docking station 112 can include a housing 114 defining a lower opening 116 and an upper opening 118. The housing 114 can include or can define a pad receptacle 120 and a pad dispenser 122. The pad receptacle 120 can include a pad bin 124, a sensor 126, and a release 128 (shown in FIGS. 2A and 2C). The pad dispenser 122 can include a shoe 130 (shown in conditions denoted by 130*a* and 130*b* in FIG. 2B), a biasing element 132 (shown in FIG. 2B), and a shoe sensor 134 (shown in FIG. 2B).

The housing 114 can be a rigid or semi-rigid body comprised of one or more of metals, plastics, foams, ceramics, or the like. The lower opening 116 of the housing 114 can be configured (e.g., sized or shaped) to receive the pad plate assembly 108 of the robot 100 therein, such as to allow the robot to discard a soiled pad from a pad tray of the pad plate assembly 108 into the pad receptacle 120. The upper opening 118 of the housing 114 can be configured (e.g., sized or shaped) to receive the pad plate assembly 108 of the robot 100 therein, such as to allow the robot 100 to retrieve or receive a fresh pad.

The pad receptacle 120 can be a pad receptacle configured to receive a soiled pad from a pad tray of a mobile cleaning robot (e.g., pad tray of the pad plate assembly 108 of the robot 100). The bin 124 can be located near the opening 116 and can be a container configured to receive pads, such as soiled pads, from the mobile cleaning robot 100. The bin 124 can be optionally removable from the housing 114 of the docking station 112. The sensor 126 can be connected to the housing 114 or the bin 124 and can be configured to produce a signal or indicator based on a detected pad fill state within the pad receptacle, such as based on contents of the bin 124. For example, the sensor 126 can be a pressure sensor, optical sensor, or the like. The release 128 can be a projection or other feature connected to a rear portion (for example) of the housing 114 and that can be configured to engage a portion of the pad plate assembly 108 such as to release a soiled mopping pad from the pad plate assembly 108.

The pad dispenser 122 can be a pad dispenser configured to provide a fresh pad to a pad tray of a mobile cleaning robot (such as a pad tray of the pad plate assembly 108). The shoe 130 can be configured to support one or more fresh pads and can be located near the opening 118 and can be movable with respect to the housing 114. The shoe 130 can be connected to the housing 114 via the biasing element 132, which can be a compression spring, or the like. As shown in FIG. 2B, the biasing element 132 can bias the shoe 130 towards the opening 118 (an access side of the docking station), such as to move the shoe 130 to the location 130*b*, such as to move a clean pad The shoe sensor 134 can be connected to the housing 114 or the shoe 130 and can be configured to produce a signal or indicator based on a detected dispenser state of the shoe 130, such as based on a location of the shoe 130 with respect to the housing 114 or the opening 118. For example, the sensor 126 can be a pressure sensor, optical sensor, Hall effect sensor, or the like.

As shown in FIG. 2A, the shoe 130 can be angled to be offset with respect to a vertical direction of a gravitational force or direction G at an angle of $\theta$. This angle can allow the pad plate assembly 108 to fall with the assistance of gravity onto a clean pad, as discussed in further detail below.

The rib or projection 128 can be connected to the housing 114 or the bin 124 and can be located near a rear portion of the docking station 112. The rib 128 can be engageable with the pad tray of the pad plate assembly 108 to release a soiled pad from the pad tray. When the soiled pad is released from the pad tray, the soiled pad can fall into the bin 124. Optionally, where the magnet of the pad plate assembly 108 does not release the pad assembly 140 from the tray (where the soiled pad stays coupled to the tray), the robot 100 can be navigated to scrape the pad from the tray of the pad plate assembly 108 to discard the pad assembly 140 into the bin 124.

Figure 3A:
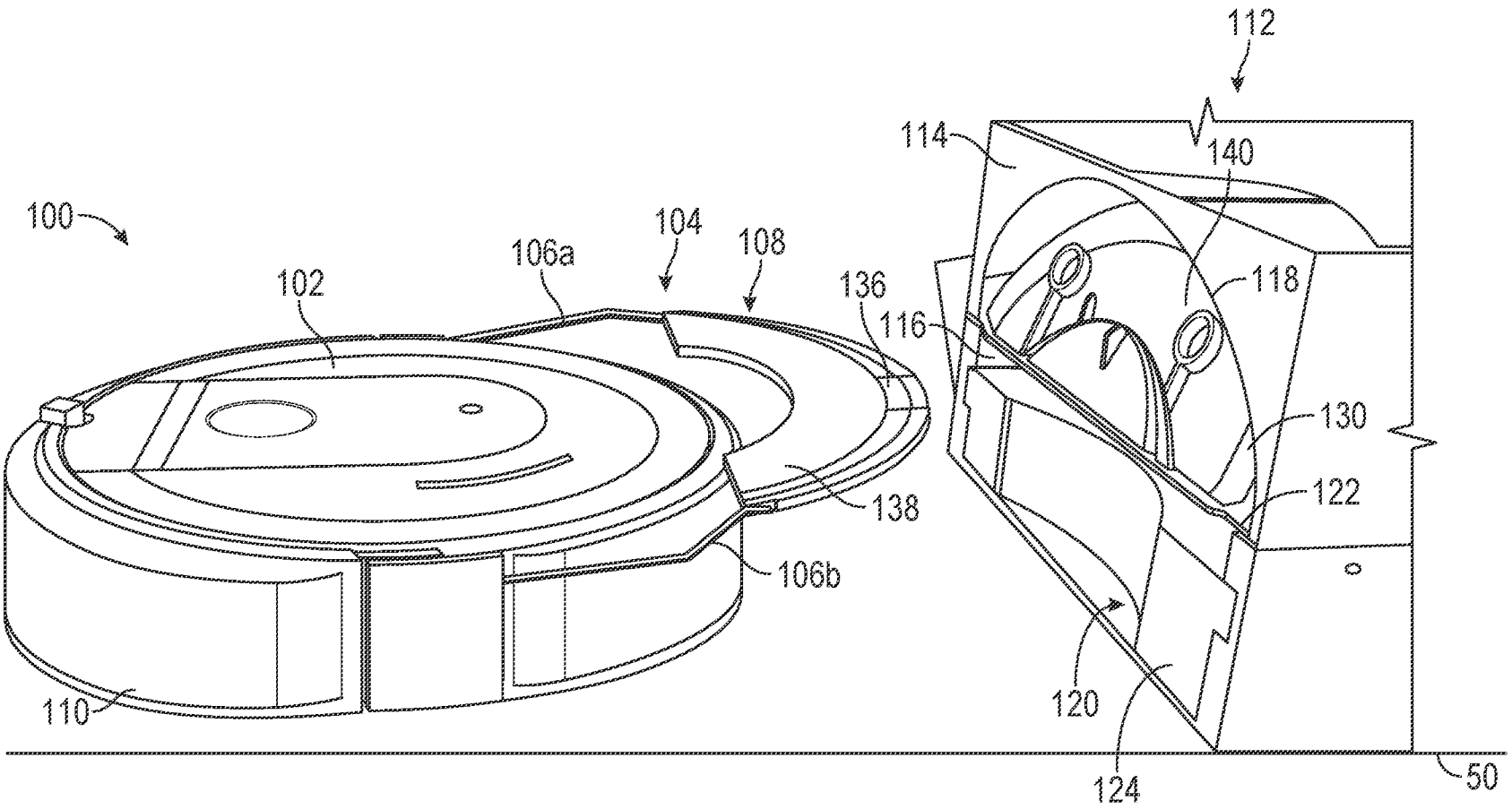
FIG. 3A illustrates an isometric view of a mobile cleaning robot and a docking station.
Figure 3B:
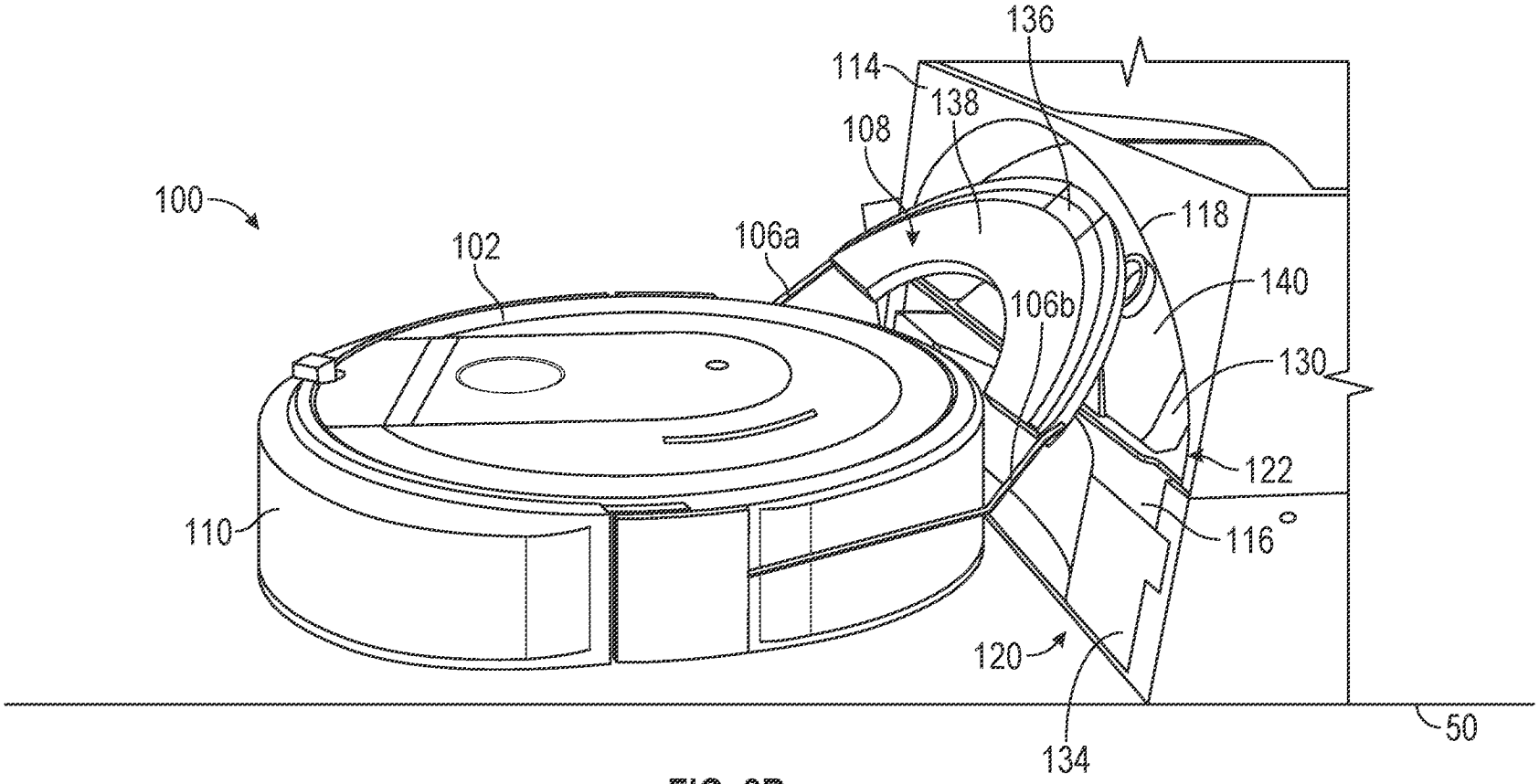
FIG. 3B illustrates an isometric view of a mobile cleaning robot and a docking station.

FIG. 3A illustrates an isometric view of the mobile cleaning robot 100 and the docking station 112. FIG. 3B illustrates an isometric view of the mobile cleaning robot and a docking station 112. FIGS. 3A and 3B are discussed together below. The robot 100 and the docking station 112 can be similar to the robot 100 and docking station of FIGS. 1A-2B discussed above; FIGS. 3A and 3B show how the robot 100 and the docking station 112 can interact.

For example, FIG. 3A shows the pad plate assembly 108 and the arms 106 of the robot 100 in an extended position, such that the pad assembly is raised off a floor surface 50 but is not in a stored position (shown in FIG. 1A). The robot 100 can be operated or navigated, such as autonomously, to move at least a portion of the pad plate assembly 108 into the lower opening 116. The pad plate assembly 108 can be moved rearward until an actuator (e.g., a button) 136 of the pad assembly engages the projection 128 of the housing 114. Such engagement can cause movement of the actuator 136 with respect to a body 138 of the pad plate assembly 108 and the robot 100, which can cause a soiled pad attached to the pad plate assembly 108 to be released from the pad plate assembly 108 and into the bin 124 of the pad receptacle 120.

As shown in FIG. 3B, following of release of the soiled pad into the pad receptacle 120, the robot 100 can (following release of the pad) from the lower opening 116 and can move the arms 106 to position the body 138 of the pad plate assembly 108 at least partially into the upper opening 118 to engage a pad assembly 140 supported by the shoe 130. Because the body 138 is free to tilt with respect to the arms 106, engagement of the body 138 with the pad assembly 140 can cause the body 138 to rotate upwards or back. The robot 100 can be moved or navigated to cause further upward movement of the body 138 with respect to the arms 106, until the pad assembly 140 is aligned with the body 138. When the pad assembly 140 is properly aligned with the body 138, the body 138 can fall with the assistance of gravity to cause the pad assembly 140 to connect to the body 138, such as through a magnetic coupling, as discussed in further detail below. To assist in magnetically coupling the pad assembly 140 to the body 138, the robot 100 can translate or turn (optionally repeatedly) to help obtain proper alignment and coupling.

Once the pad assembly 140 is secured to the body 138, the robot 100 can move the pad plate assembly 108 (including the pad assembly 140) out of the opening 118 and away from the docking station 112, allowing the robot 100 to begin or to continue a cleaning (e.g., mopping) mission or activity. In this way, the robot 100 can use the docking station 112 to discard soiled pads and retrieve fresh or clean pads.

Figure 4A:
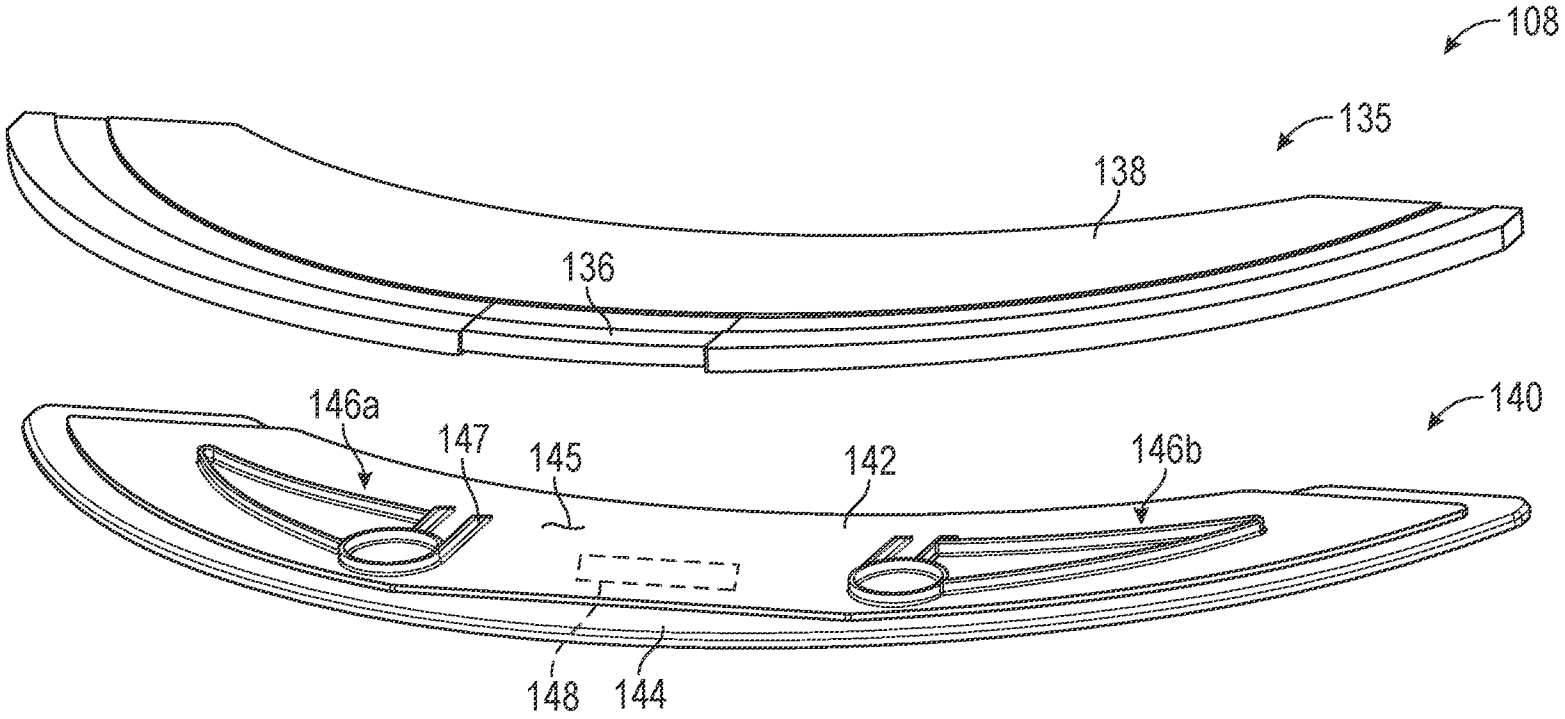
FIG. 4A illustrates an isometric top view of a pad tray and pad of a mobile cleaning robot.

FIG. 4A illustrates an isometric top view of the pad plate assembly 108 of the mobile cleaning robot 100. The pad plate assembly 108 of the robot 100 can be similar to the pad tray discussed above; FIG. 4A shows additional details of the pad assembly. For example, FIG. 4A shows that the pad plate assembly 108 can include a pad tray 135 including the body 138 and the actuator 136. The pad assembly 140 can include a pad backer 142 and mopping pad 144. The pad backer 142 can include mating features 146*a* and 146*b* and a ferrous plate 148.

The pad backer 142 can be a rigid or semi-rigid body made of plastic or non-ferrous materials. The pad backer 142 can be relatively wide with a small thickness to help reduce weight and cost. The mopping pad 144 can be a cleaning media, such as microfiber, cotton, bamboo, nylon, or the like. Though the mopping pad 144 is referred to as a mopping pad, implying wet mopping, the mopping pad 144 can be a dry mopping pad or, more generally, any cleaning pad. The mopping pad 144 can be connected to the pad backer 142.

The mating features 146*a* and 146*b* can be features extending from a top surface 145 of the pad backer 142, where the mating features 146 can be insertable into recesses of the body 138 to align the pad backer 142 with the pad tray 135 and allow coupling of the pad backer 142 to the tray 135. Optionally, the mating features 146*a* and 146*b* can be sloped from front to rear, such as at ramp 147, which can allow an underside of the pad tray 135 to ride up the features, such as to avoid catching on the features when a fresh pad is being attached to the pad tray 135. The ferrous plate 148 can be a metal plate made of ferrous materials such that the plate 148 is magnetically attractable by a magnet of the actuator 136. The plate 148 can be connected to the pad backer 142 and can be located below the surface 145 or can be embedded in the pad backer 142.

Figure 4B:
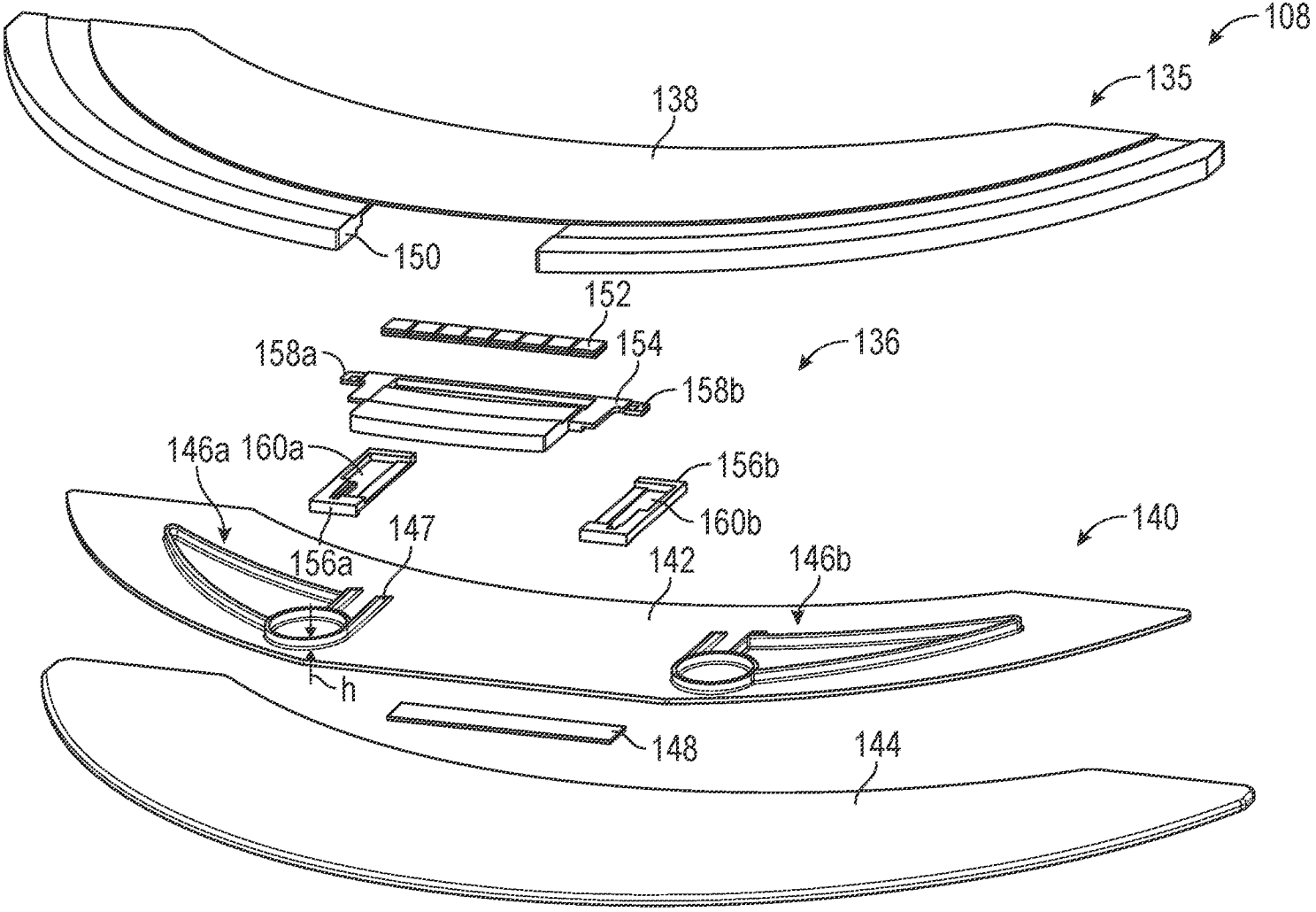
FIG. 4B illustrates an isometric exploded view of a pad tray and pad of a mobile cleaning robot.

FIG. 4B illustrates an isometric exploded view of the pad plate assembly 108. The pad plate assembly 108 of the robot 100 can be similar to the pad tray discussed above; FIG. 4B shows additional details of the pad assembly. For example, FIG. 4B shows an opening 150 in the body 138 of the pad tray 135. The opening 150 can support the actuator 136, which can be an assembly of parts.

The actuator 136 can include a magnet (or magnet array 152), a translating member 154, and guides 156*a* and 156*b*. The guides 156*a* and 156*b* can be connected to the body 138 on respective sides of the opening 150. Ears or tabs 158*a* and 158*b* of the translating member 154 can be inserted into slots or channels 160*a* and 160*b*, respectively, of the guides 156*a* and 156*b*, respectively. Such engagement can allow for limited translation of the sliding member 154 with respect to the guides 156*a* and 156*b* and therefore with respect to the body 138 to which the guides 156 are connected. The guides 156*a* and 156*b* can also include a spring or biasing element (e.g., compression spring, leaf spring, wave spring, or the like) engaged with or engageable with the translating member 154 and the guides 156. The biasing element can bias the actuator towards a rear portion of the tray 135.

The magnet 152 can be a connected to the translating member 154 such that movement of the translating member 154 causes movement of the magnet array 152. The magnet 152 can be an array of magnets or can be a single magnet. In either case, the magnet 152 can be configured such that the flux of the magnet 152 does not extend (or minimally extends beyond) the ferrous plate 148 when the ferrous plate 148 is coupled to the magnet 152. The magnet 152 can be coupled to the ferrous plate 148 to secure the pad assembly 140 to the pad plate assembly 108. Movement of the translating member 154 can cause movement of the magnet 152 with respect to the pad assembly 140, which can cause misalignment between the magnet 152 and the ferrous plate 148, causing the ferrous plate 148 to decouple from the magnet and causing separation of the pad assembly 140 from the pad plate assembly 108.

Also, optionally, the magnet 152 can be configured such that the force generated by the magnet 152 to attract the plate 148 is not strong enough to cause the pad assembly 140 to move to couple the ferrous plate 148 to the magnet 152 when the pad backer 142 of the pad assembly 140 is at a distance from an underside of the tray 135 equal to or greater than a height h of the mating features 146. In this way, incorrect coupling of the pad assembly 140 and the tray 135 can be reduced by ensuring that the ferrous plate 148 does not couple to the magnet 152 until the mating features 146*a* and 146*b* are aligned and at least partially inserted into mating bores of the tray (shown in FIGS. 5A and 5B below).

Figure 5A:
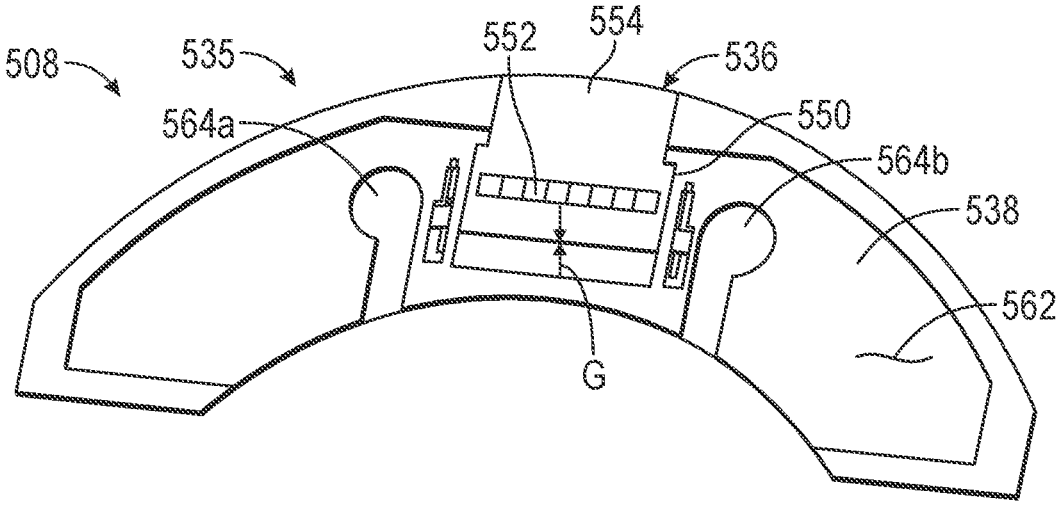
FIG. 5A illustrates an isometric bottom view of a pad tray.
Figure 5B:
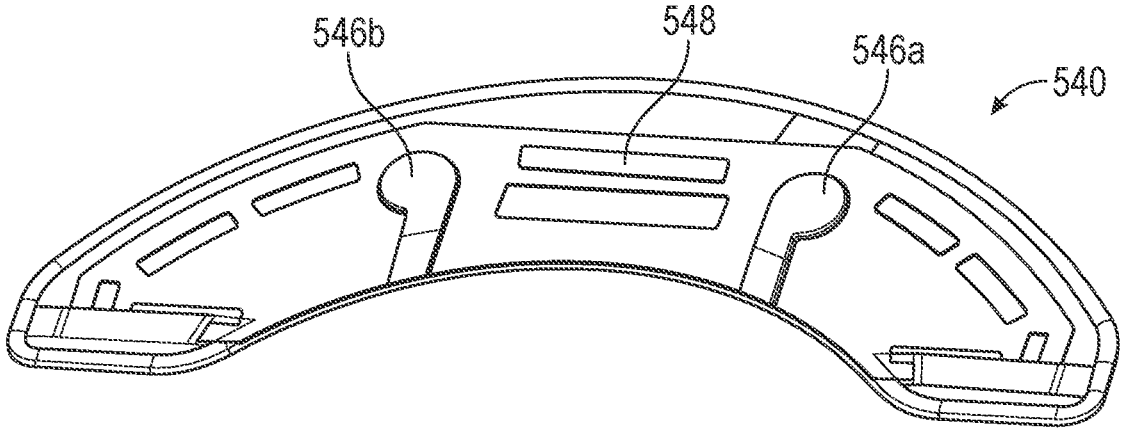
FIG. 5B illustrates an isometric top view of a pad.

FIG. 5A illustrates an isometric bottom view of a pad tray 535 of a pad plate assembly 508. FIG. 5B illustrates an isometric top view of a pad assembly 540 of the pad plate assembly 508. FIGS. 5A and 5B are discussed together below. The pad tray 535 and pad assembly 540 of the pad plate assembly 508 can be similar to the pad plate assembly 108 discussed above, where like numerals can represent like components.

FIG. 5A shows how a body 538 of the tray 535 can include recessed portions 564*a* and 564*b* that can be recessed into a bottom surface 562 of the tray 535 and can be configured (e.g., sized and shaped) to receive, at least partially, mating features 546*a* and 546*b* (shown in FIG. 5B), respectively, of the pad assembly 540, such as to orient the mopping pad assembly 540 with respect to the tray 535. Such orientation can allow a magnet 552 of an actuator 536 to magnetically couple to a plate 548 (e.g., magnetically attractive member embedded into the pad assembly) of the pad assembly 540. The features 546*a* and 546*b* insertion into the recessed portions 564*a* and 564*b* can also align wing magnets that are shown and discussed below.

FIG. 5A also shows a gap G between the actuator 536 and the body 538 of the tray 535, which can define a range of motion that a translating member 554 can move with respect to the body 538. When the actuator 536 (positioned in an opening 550 of the body 538) is in a fully extended (and biased) position, as shown in FIG. 5A, the magnet 552 can be alignable with the plate 548 when the mating features 546*a* and 546*b* are in the recesses 564*a* and 564*b*, respectively.

When the translating member is moved to reduce or eliminate the gap G, the magnet 552 can be moved away from the plate 548 (and optionally in line with an opening 549) while the mating features 546 and recessed portions limit relative movement of the pad assembly 540 and the pad tray 535. This action can cause separation and de-coupling of the magnet 552 and the plate 548, allowing the pad assembly 540 to separate from the tray 535, such as under the force of gravity. In this way, when the actuator 536 is operated, such as by engagement with the projection 128 of the docking station 112, the pad assembly 540 (or the pad assembly 140) can fall into the pad receptacle 120. Because the actuator 536 can be biased to a rearward position (shown in FIG. 5A), the actuator can return to the rear position when the robot 100 is navigated so that the projection 128 is no longer contacting the actuator 536 (or the actuator 136).

Figure 6A:
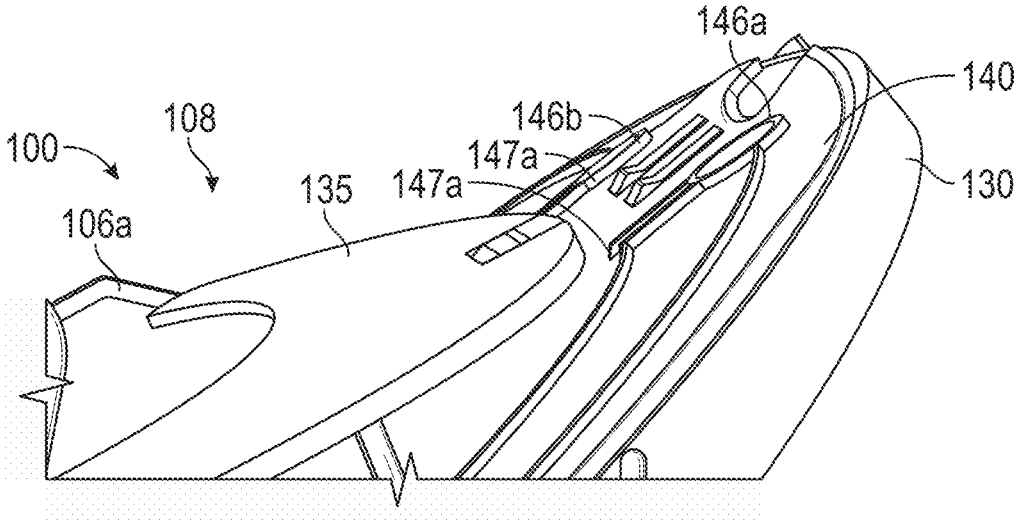
FIG. 6A illustrates a perspective side view of a pad tray and pad of a mobile cleaning robot.
Figure 6B:
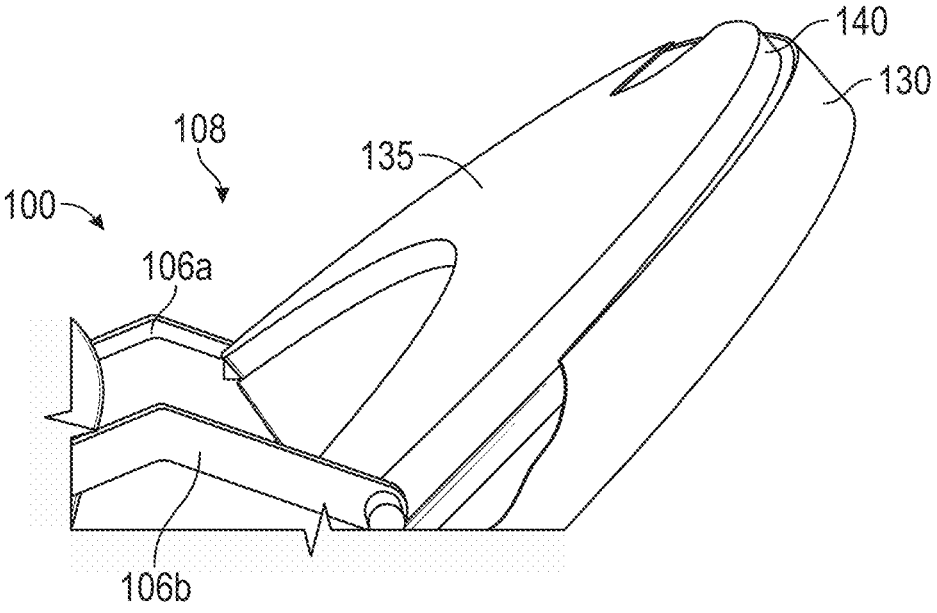
FIG. 6B illustrates a perspective side view of a pad tray and pad of a mobile cleaning robot.

FIG. 6A illustrates a perspective side view of the pad tray 135 and the pad assembly 140 of the mobile cleaning robot 100. FIG. 6B illustrates a perspective side view of the pad tray 135 and the pad assembly 140 of the mobile cleaning robot 100. The robot 100 of FIGS. 6A and 6B can be similar to the robot 100 discussed above with respect to FIGS. 1A-4B; FIGS. 6A-6B show how the tray 135 can mate to the pad assembly 140.

For example, FIG. 6A shows how the arms 106 can be extended such that the tray 135 engages the pad assembly 140 when the pad assembly 140 is supported by the shoe 130 of the docking station 112. When the robot 100 moves the tray 135 along the pad assembly 140, the tray 135 can engage the ramps 147*a* and 147*b* of the mating features 146*a* and 146*b* to avoid catching on a lip or other feature of the tray 135.

As shown in FIG. 6B, the robot 100 can move the tray 135 until the projections 146*a* and 146*b* are located within the receiving slots of the tray 135 (similar to the slots 564*a* and 564*b*), allowing the magnet 152 to couple to the ferrous plate 148 to secure the pad assembly 140 to the tray 135. Following coupling of the tray 135 to the pad assembly 140, the robot 100 can move the pad assembly 140 and tray 135 from the shoe 130.

Figure 7A:
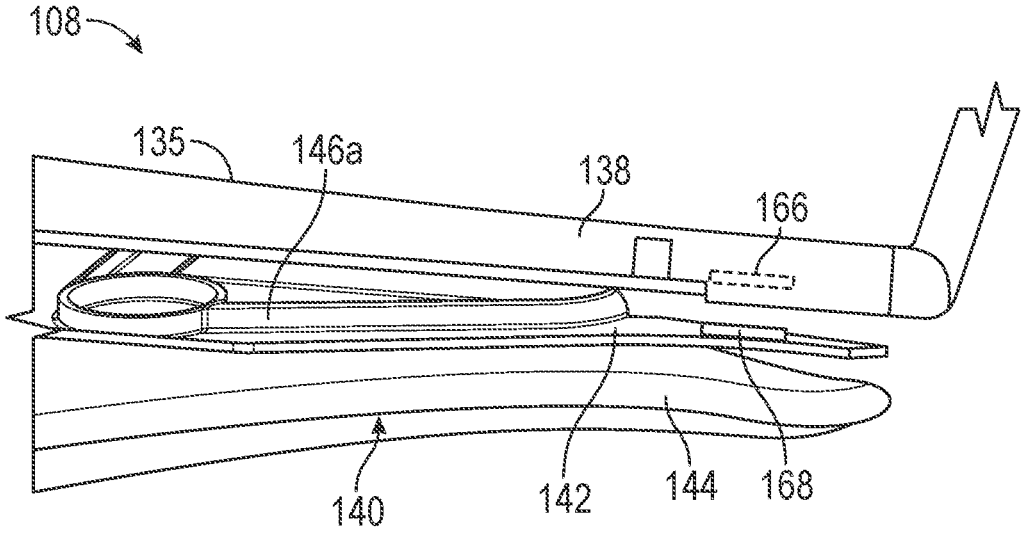
FIG. 7A illustrates a side view of a pad tray and pad of a mobile cleaning robot.
Figure 7B:
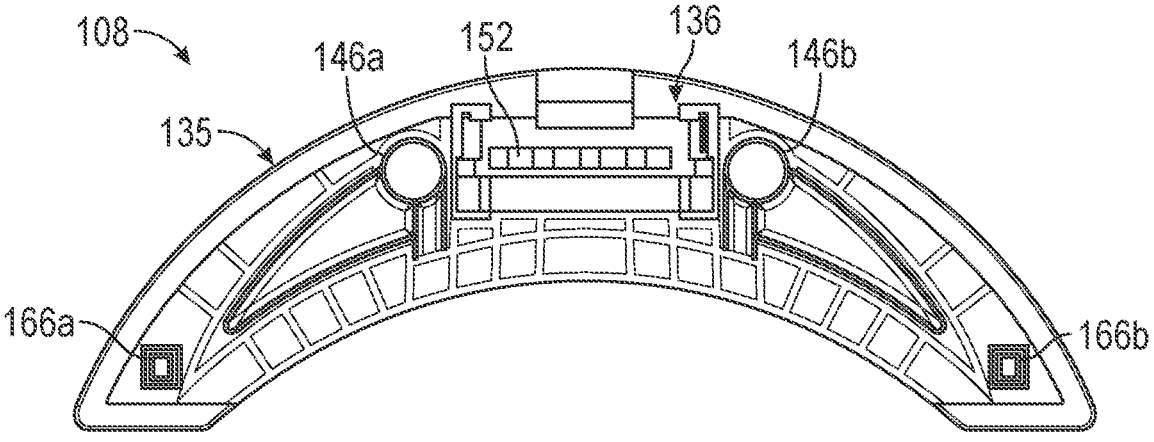
FIG. 7B illustrates a bottom view of a pad tray of a mobile cleaning robot.

FIG. 7A illustrates a side view of a pad tray 135 and pad assembly 140 of the mobile cleaning robot 100. FIG. 7B illustrates a bottom view of the pad tray 135 of a mobile cleaning robot 100. The robot 100 of FIGS. 7A and 7B can be similar to the robot 100 discussed above with respect to FIGS. 1A-4B and 6A-6B; FIGS. 7A-7B show how the tray 135 can mate to the pad assembly 140.

For example, FIG. 7A shows that the tray 135 can include a second magnet 166 (or wing magnet) and the pad backer 142 of the pad assembly 140 can include a second ferrous plate or magnetically attractable portion 168. The ferrous plate 168 can be magnetically couplable to the second magnet 166 to secure a wing portion or forward portion of the pad assembly 140 to a forward portion or wing portion of the tray 135, which can help to reduce peeling of the pad assembly 140 from the tray 135 caused by friction or engagement with objects during cleaning missions.

The magnets 166*a* and 166*b* (shown in FIG. 7B) can create a coupling force (e.g., together with the secondary plates 168) that is strong enough to limit the wings or forward portion of the pad assembly 140 from separating from the tray 135, but weak enough that the pad assembly 140 will separate from the tray 135 when the actuator 136 is actuated to disengage the magnet 152 from the plate 148. For example, the wing magnets 166 can be configured (e.g., sized and shaped) to support about 10%, 15%, 20%, 25%, or the like of the weight of the pad. Optionally, the wing magnets 166 can include a multi-pole array of magnets to increase short attraction and decrease long attraction between the magnets 166 and the plates 168.

Figure 8A:
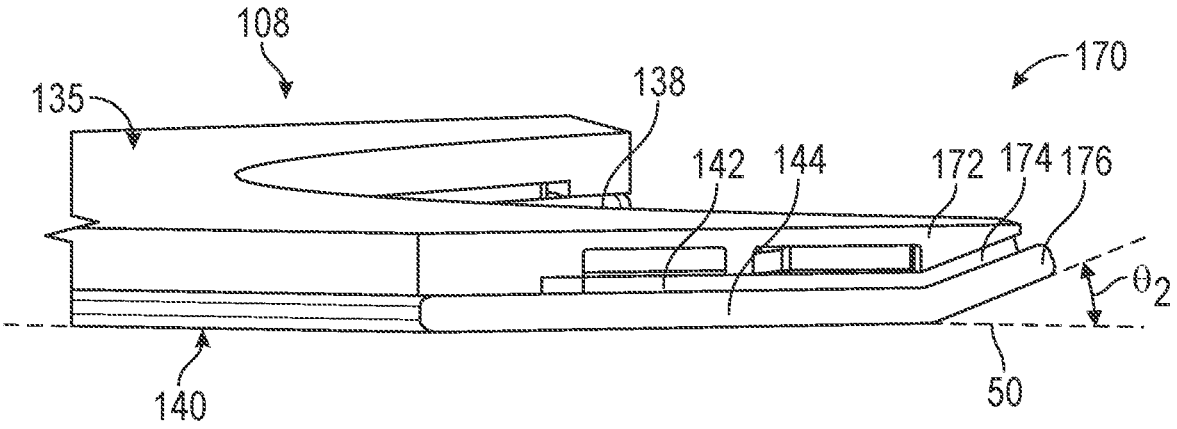
FIG. 8A illustrates an isometric side view of a pad tray and pad of a mobile cleaning robot.
Figure 8B:
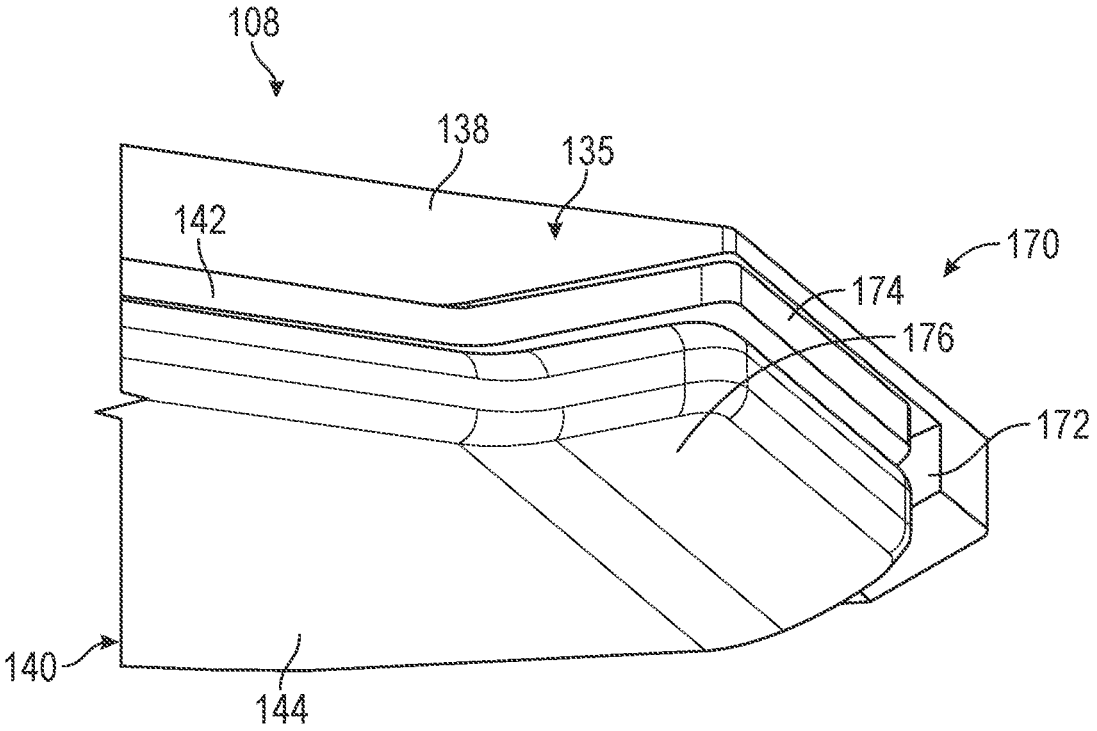
FIG. 8B illustrates an enlarged isometric side view of a pad tray and pad of a mobile cleaning robot.

FIG. 8A illustrates an isometric side view of the pad tray 135 and the pad assembly 140 of the mobile cleaning robot 100. FIG. 8B illustrates an enlarged isometric side view of the pad tray 135 and the pad assembly 140 of the mobile cleaning robot 100. The pad tray 135 and the pad assembly 140 of the mobile cleaning robot 100 of FIGS. 8A and 8B can be similar to the pad tray 135 and the pad assembly 140 of the mobile cleaning robot 100 discussed above with respect to FIGS. 1A-4B and 6A7B; FIGS. 8A-8B show how additional features of the pad plate assembly 108.

For example, FIGS. 8A and 8B show that a forward portion of the pad (wing) 170 can form an angle θ2 with respect to the floor surface 50 when the mopping pad 144 is engaged with the floor. Such an upswept angle at the wings can help to reduce peeling of the pad assembly 140 from the tray 135 caused by friction or engagement with objects during cleaning missions. More specifically, the body 138 of the pad tray 135 can include a recess 172 that can receive an angled portion 174 of the pad backer 142 of the pad assembly 140. An angled portion 176 of the mopping pad 144 can be connected to the angled portion 174 of the pad backer 142 to, together, form the upswept or angled wing 170 at the angle θ2. The angle θ2 can help to ensure that debris, thresholds, or other items that may engage the leading edge of the mopping pad 144 do not cause separation of the pad assembly 140 from the tray 135. The angle θ2 can be between 30 and 60 degrees in some examples.

Figure 9A:
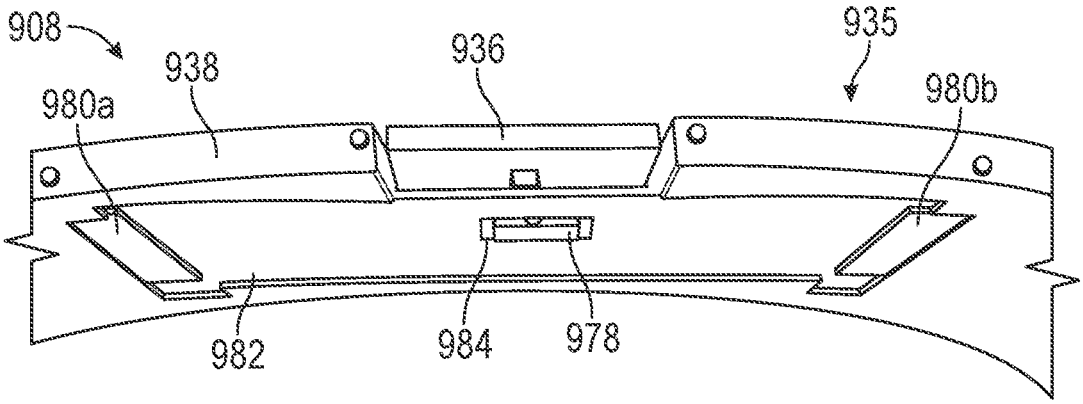
FIG. 9A illustrates a bottom perspective view of a pad assembly of a mobile cleaning robot.
Figure 9B:
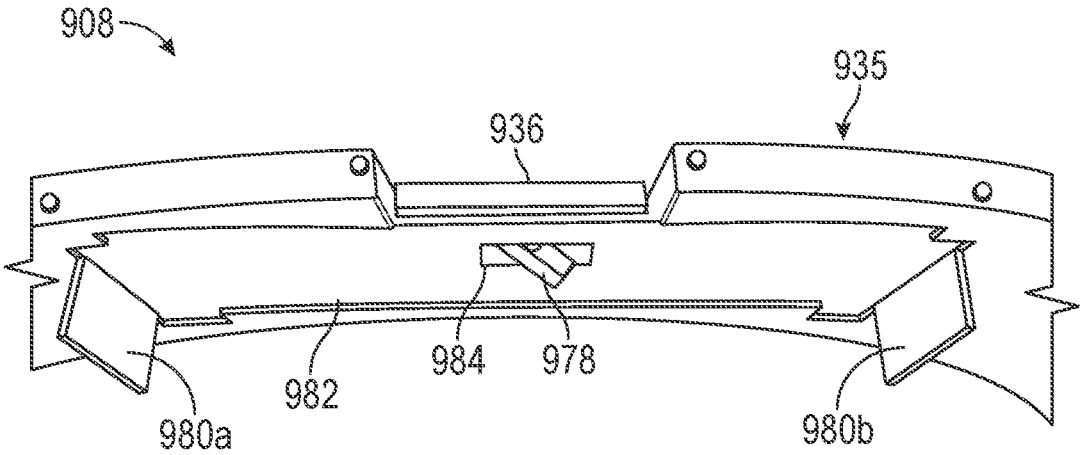
FIG. 9B illustrates a bottom perspective view of a pad assembly of a mobile cleaning robot.

FIG. 9A illustrates a bottom perspective view of a pad plate assembly 908 of a mobile cleaning robot. FIG. 9B illustrates a bottom perspective view of the pad plate assembly 908. The pad plate assembly 908 can include a pad tray 935 that is similar to those discussed above; the pad tray 935 can differ in that the tray can secure pads thereto using a flap mechanism. Any of the pad assemblies discussed above or below can be modified to include such a pad tray.

The pad tray 935 can include an actuator 936 including a catch 978 and flaps 980*a* and 980*b*. A body 938 of the pad tray 935 can include a slot 982 and a catch opening 984. The slot 982 can extend into a bottom surface of the body 938 and can be configured to receive a portion of a pad, such as a mounting card, therein. The catch opening 984 can be located in the slot 982 and can extend at least partially through the body 938 and can be aligned with at least a portion of the actuator 936 such as the catch 978. The catch 978 can be rotatably positioned in the catch opening 984 and can be operated by the actuator 936. The flaps 980*a* and 980*b* can be connected to the body 938 at opposite sides of the slot 982. The flaps 980*a* and 980*b* can be rotatably connected to the body 938 and can be actuated or operated by the actuator 936.

In operation, the actuator 936 can be in an unactuated position to which it is biased, as shown in FIG. 9A, where the catch 978 and the flaps 980 can retain a portion of a mounting card therein. When it is desired to release a pad (e.g., a soiled pad), the actuator 936 can be operated (such as is discussed with respect to FIGS. 2A and 2B) and the flaps 980*a* and 980*b* can open and the catch 978 can rotate to release the mounting card from the tray 935. The catch 978 and flaps 980 can remain in the open position until a mounting card or other item contacts the catch 978, which can cause the catch 978 to rotate and the flaps 980 to close to secure a mounting card of, for example, a clean pad. Such a pad tray can be used by a mobile cleaning robot to dispose of a soiled pad and retrieve a fresh pad autonomously.

Figure 10:
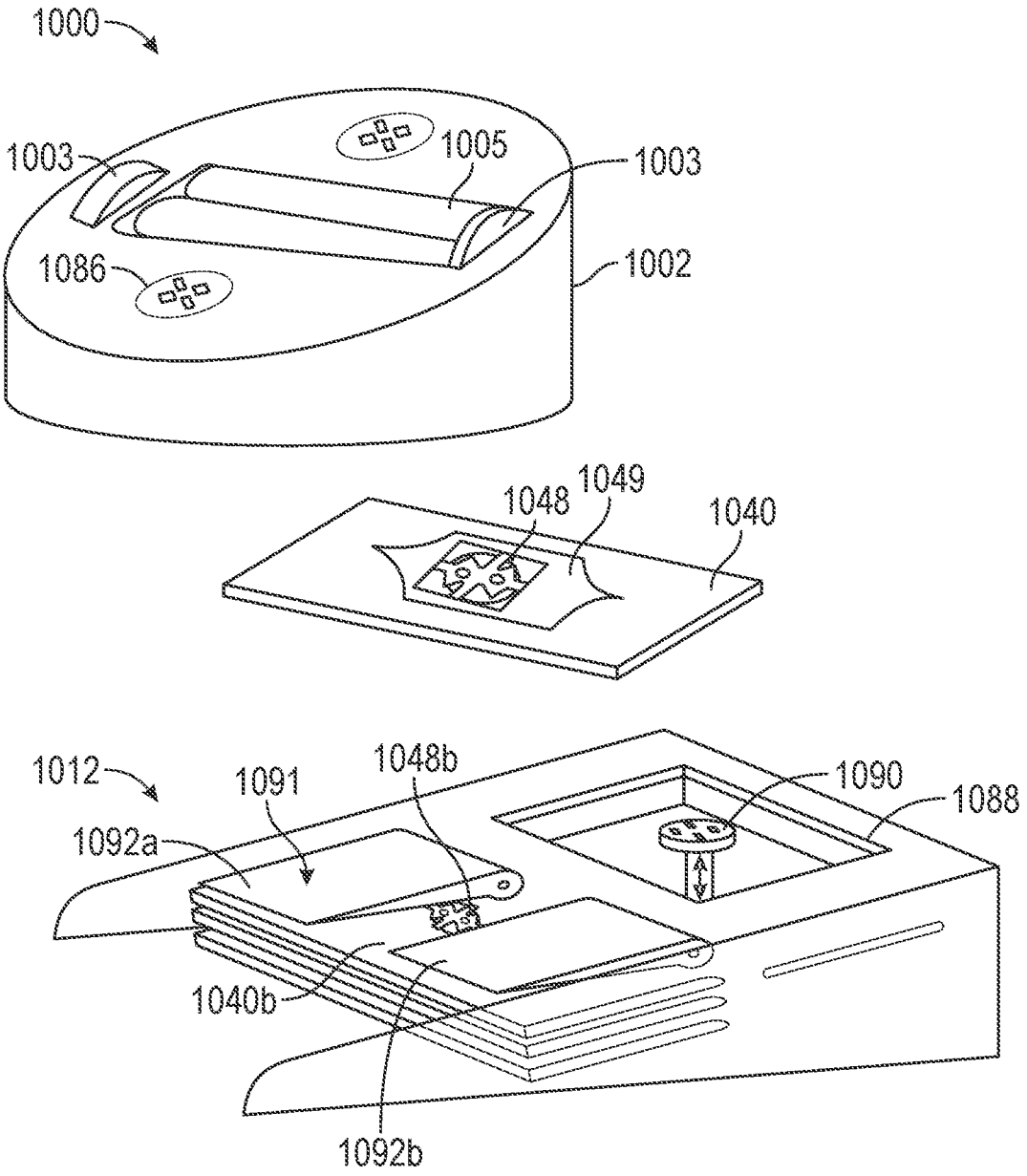
FIG. 10 illustrates a perspective view of a mobile cleaning robot and a docking station.

FIG. 10 illustrates a perspective view of a mobile cleaning robot 1000 and a docking station 1012. The mobile cleaning robot 1000 and docking station 1012 can be similar to those discussed above; the robot 1000 and docking station 1012 can differ in that the docking station 1012 can include a magnet for retrieving soiled pads from the robot. Any of the robots and docking stations discussed above or below can be modified to include such a system.

The robot 1000 can include a body 1002, drive wheels 1003, and an extractor 1005. The body can include a magnet 1086 or array of magnets. Optionally, the robot 1000 can include a pad assembly (such as the pad plate assembly 108 discussed above) that can include the magnet 1086. The magnet 1086 can be configured to interact with a ferrous plate 1048 of a pad 1040 for coupling of the pad 1040 to the robot 1000. Optionally, the pad 1040 can include a hole or recess 1049 such that the ferrous plate 1048 can be accessible from both sides of the pad 1040.

The docking station 1012 can include a pad receptacle 1088 and a retrieval magnet 1090. During retrieval of a soiled pad from the robot 100, the robot 100 can navigate to align the plate 1048 of the pad 1040 with the retrieval magnet 1090. The docking station 1012 can then translate or move the retrieval magnet 1090 to engage the plate 1048, such as from an underside of the robot 100. The retrieval magnet 1090 can be configured to generate a stronger magnetic force on the plate 1048 than the magnet 1086 such that the retrieval magnet 1090 can pull the plate 1048 and the pad 1040 off the magnet 1086 and the robot 1000.

After discarding the pad 1040, the robot 1000 can navigate to a pad dispenser 1091 of the docking station 1012 and the magnet 1086 can attract a pad ferrous plate 1048*b* of a fresh pad 1040*b* held in the dispenser 1091. Arms or flaps 1092*a* and 1092*b* of the dispenser 1091 can allow the robot 1000 to retrieve the pad 1040*b* as the robot 1000 exits the docking station 1012. In this way, the docking station can discard soiled pads and provide fresh pads to the robot 1000.

Figure 11:
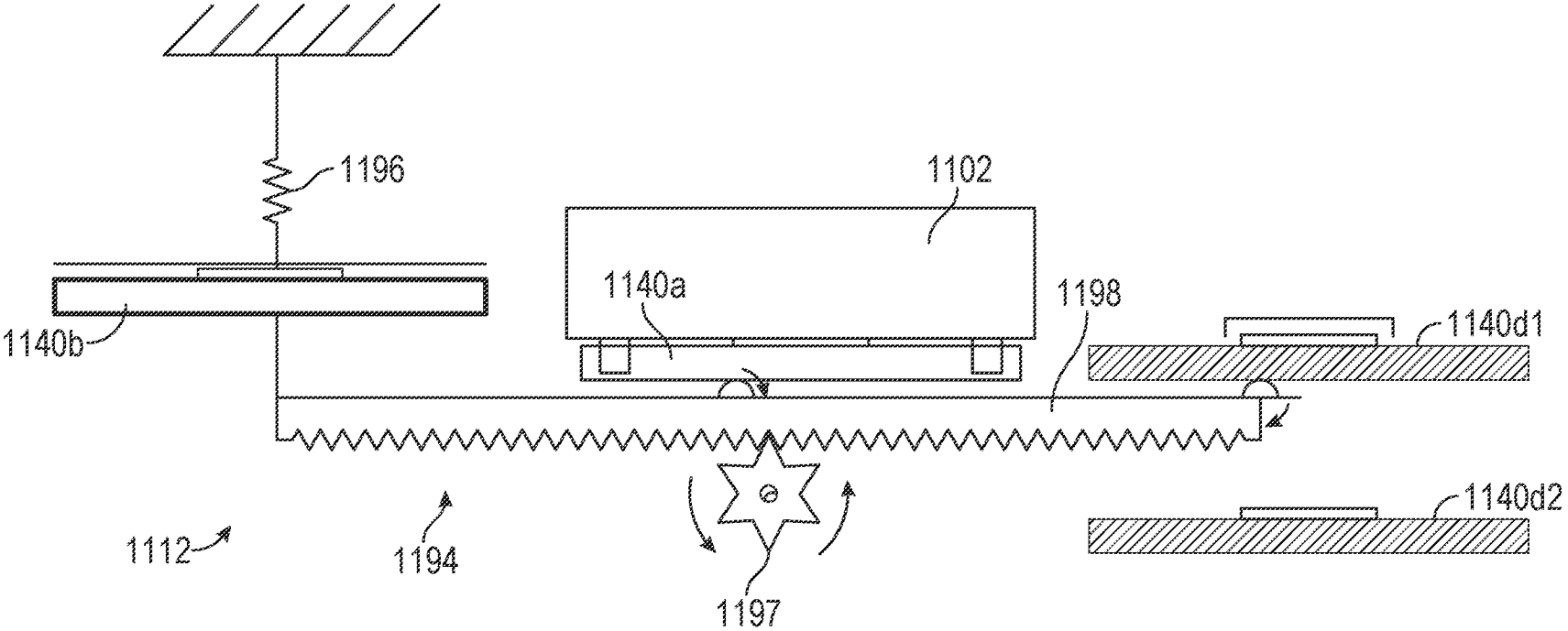
FIG. 11 illustrates a perspective view of a mobile cleaning robot and a docking station.

FIG. 11 illustrates a perspective view of a mobile cleaning robot 1100 and a docking station 1112. The mobile cleaning robot 1100 and docking station 1112 can be similar to those discussed above; the robot 1100 and docking station 1112 can differ in that the docking station 1112 can include a conveyor system for changing pads. Any of the robots and docking stations discussed above or below can be modified to include such a system.

The conveyor system can include a delivery device 1196, which can be a spring or biasing element configured to deliver a fresh pad 1140*b* to replace a soiled pad 1140*a*. The delivery device 1196 can deliver the fresh pad 1140*b* to a track or rack 1198 of a conveyor system 1194. A drive gear or pinion 1197 can be engaged with the track 1198 to translate or move the track 1198. The track 1198 can be moved or translated to move the soiled pad 1140*a* from the robot 1102 to deliver the fresh pad 1140*b*. The soiled pad 1140*a* can be moved along the track to the position of the soiled pad 1140*a*1 where the track can discard the pad to a receptacle as shown by the pad in the position 1140*a*2. In this way, the docking station 1112 can discard soiled pads and provide fresh pads to the robot 1100.

Figure 12B:
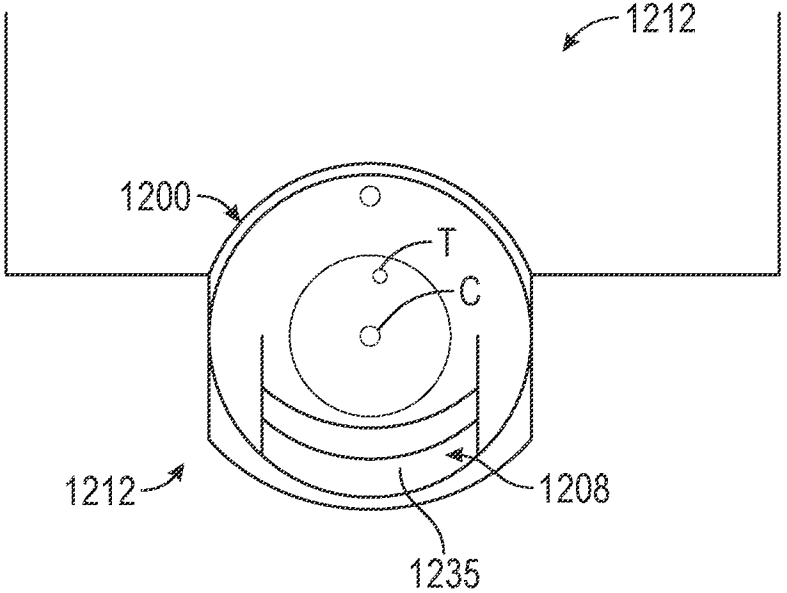
FIG. 12B illustrates a top view of a mobile cleaning robot and a docking station.
Figure 12A:
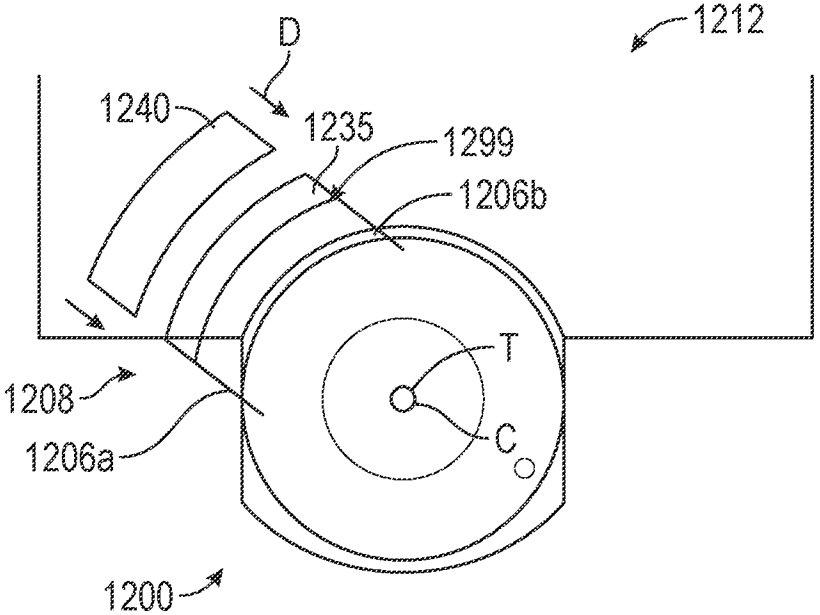
FIG. 12A illustrates a top view of a mobile cleaning robot and a docking station.

FIG. 12A illustrates a top view of a mobile cleaning robot 1200 and a docking station 1212. FIG. 12B illustrates a top view of the mobile cleaning robot 1200 and the docking station 1212. FIGS. 12A and 12B are discussed together below. The mobile cleaning robot 1200 and docking station 1212 can be similar to those discussed above; the robot 1200 and docking station 1212 can differ in that the docking station 1212 can include a rotating pad changing system. Any of the robots and docking stations discussed above or below can be modified to include such a system.

The robot 1200 can be configured such that it can extend arms 1206*a* and 1206*b* to a pad replacement position that is different from a cleaning or storage position. A tray 1235 of a pad assembly 1208 of the robot 1200 can include a track 1299 that is curved or arced. The curvature of the track 1299 can be configured such that its center of curvature T is concentric with a rotational center C of the robot 1200 when the robot 1200 hold the tray 1235 in the extended position (as shown in FIG. 12A) and such that the center of curvature T is not concentric with the rotational center C of the robot 1200 when the robot 1200 holds the tray 1235 in the cleaning or stored position (as shown in FIG. 12B). This can help to prevent the pad 1240 from being accidentally removed from the tray 1235 during a cleaning operation while allowing the pad 1240 to be replaced during a replacement operation.

During such a replacement operation, the docking station 1212 can provide a new pad 1240 into a position for receipt by the track 1299. The robot 1200 can extend the arms 1206 to place the tray 1235 in a position such that the center of curvature T of the track 1299 is concentric with the rotational center C of the robot 1200. The robot 1200 can rotate to engage a clean pad 1240 with a soiled pad. Such engagement during rotation can force the soiled pad out of the track 1299 and the fresh pad 1240 into the track 1299. Once the new pad is positioned in the track 1299, the robot 1200 can move the arms 1206 and tray 1235 to a cleaning or stored position and can navigate away from the docking station 1212.

Figure 13B:
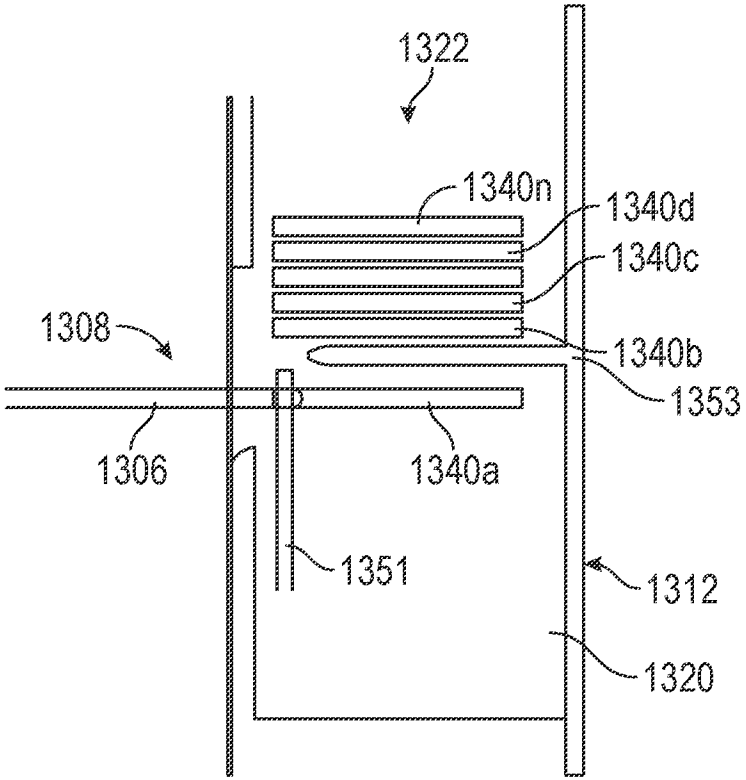
FIG. 13B illustrates a side view of a mobile cleaning robot and a docking station.
Figure 13A:
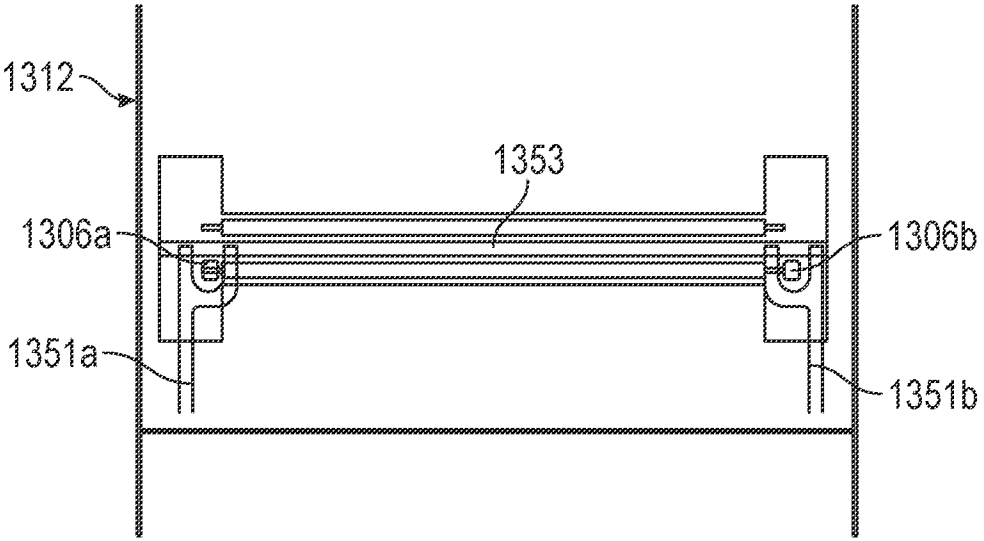
FIG. 13A illustrates a front view of a mobile cleaning robot and a docking station.
Figure 13D:
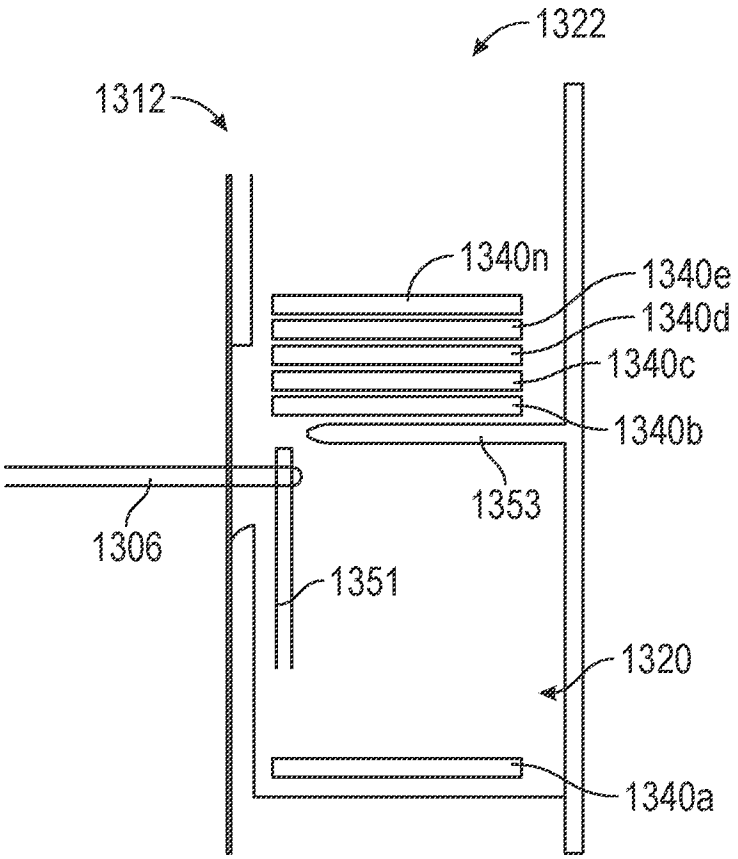
FIG. 13D illustrates a side view of a mobile cleaning robot and a docking station.
Figure 13C:
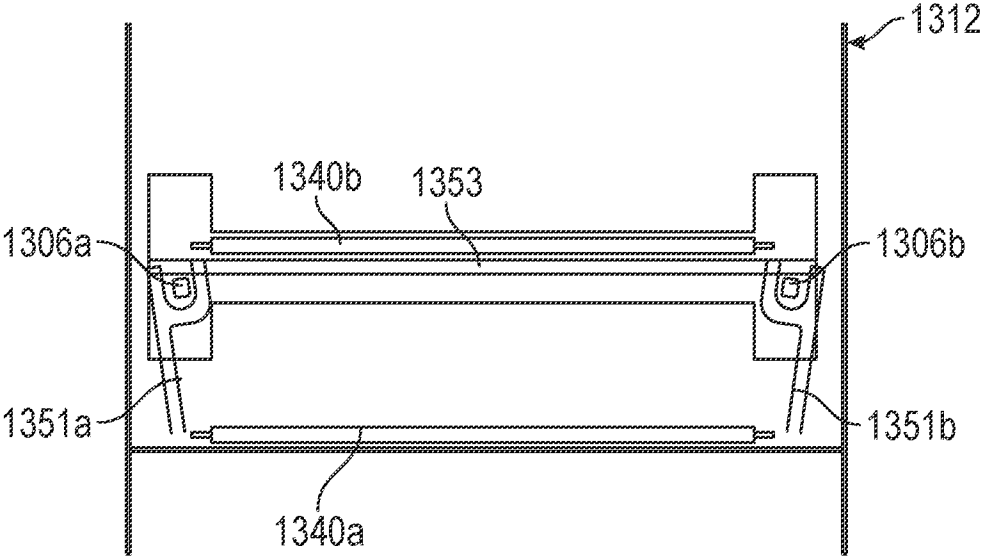
FIG. 13C illustrates a front view of a mobile cleaning robot and a docking station.
Figure 13F:
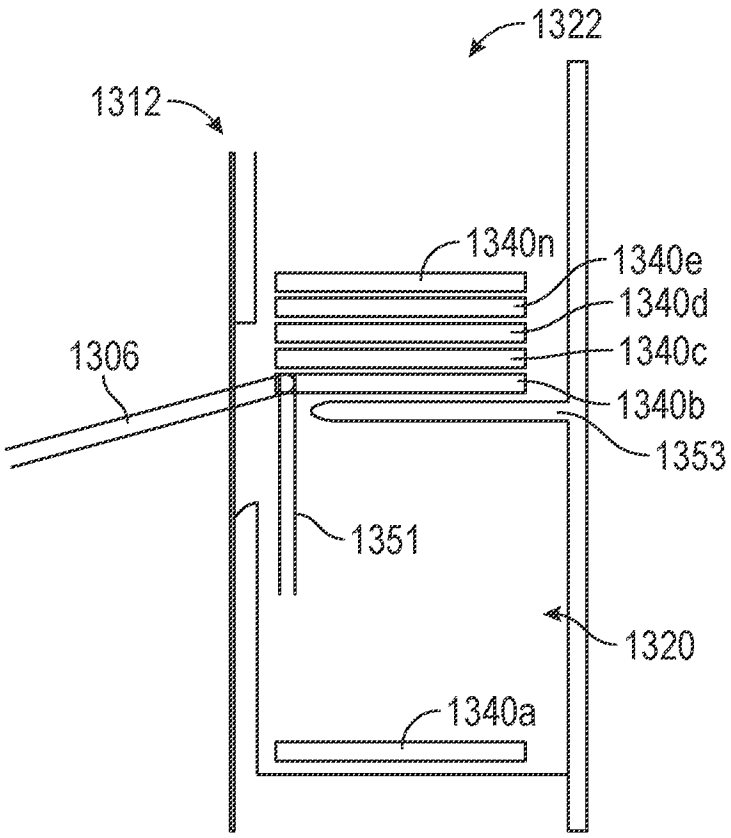
FIG. 13F illustrates a side view of a mobile cleaning robot and a docking station.
Figure 13E:
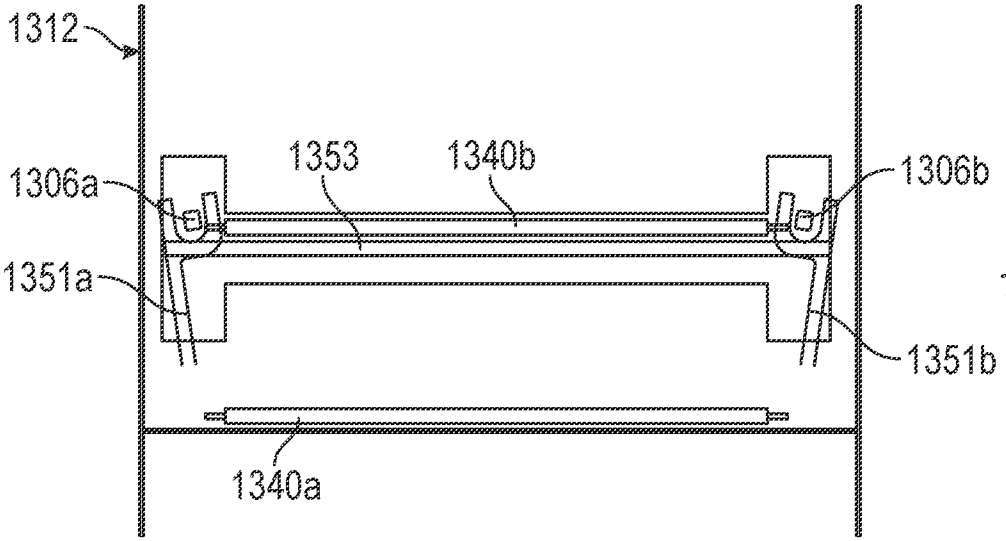
FIG. 13E illustrates a front view of a mobile cleaning robot and a docking station.

FIG. 13A illustrates a front view of a portion of mobile cleaning robot and a docking station 1312. FIG. 13B illustrates a side view of a portion of the mobile cleaning robot and the docking station 1312. FIG. 13C illustrates a front view of a portion of the mobile cleaning robot and the docking station 1312. FIG. 13D illustrates a side view of a portion of the mobile cleaning robot and the docking station 1312. FIG. 13E illustrates a front view of a portion of the mobile cleaning robot and the docking station 1312. FIG. 13F illustrates a side view of a portion of the mobile cleaning robot and the docking station 1312. FIGS. 13A-13F are discussed together below. The mobile cleaning robot and docking station 1312 can be similar to those discussed above; the robot and docking station 1312 can differ in that the docking station 1312 can include a pair of hooks for removing and replacing pads. Any of the robots and docking stations discussed above or below can be modified to include such a system.

FIGS. 13A and 13B show that arms 1306*a* and 1306*b* can be moved to insert the pad assembly 1308 of the pad 1340*a* into a pad receptacle 1320 of the docking station 1312. When in the docking station, the arms 1306*a* and 1306*b* can be engaged by hooks 1351*a* and 1351*b*. The arms 1306*a* and 1306*b* can be made of a flexible material, such as spring steel, nitinol or the like. Because the arms 1306 are flexible, the hooks 1351*a* and 1351*b* can be moved (such as by an actuator of the docking station 1312) outward, as shown in FIG. 13C, to allow the pad 1340*a* to be released from the arms 1306. When the pad 1340*a* is released from the arms 1306, the pad 1340*a* can fall into the pad receptacle 1320 as shown in FIG. 13D. Optionally, the arms 1306 can be hinged, such as with a spring that biases the arms 1306 towards each other and towards the center of the pad 1340.

With the arms 1306*a* and 1306*b* still held apart by the hooks 1351*a* and 1351*b*, respectively, the arms 1306 and hooks 1351 can move above a divider 1353 into a pad dispenser 1322, as shown in FIG. 13F. The arms 1306 can then be positioned (such as autonomously by the robot) to engage a fresh pad 1340*b* (of pads 1340*b*-1340*n*), as shown in FIG. 13E. The hooks 1351 can then release the arms 1306 to allow the arms 1306 to secure the pad 1340*b* thereto. The robot can then be navigated out of the docking station to complete or continue its cleaning mission (e.g., mopping mission).

Figure 14:
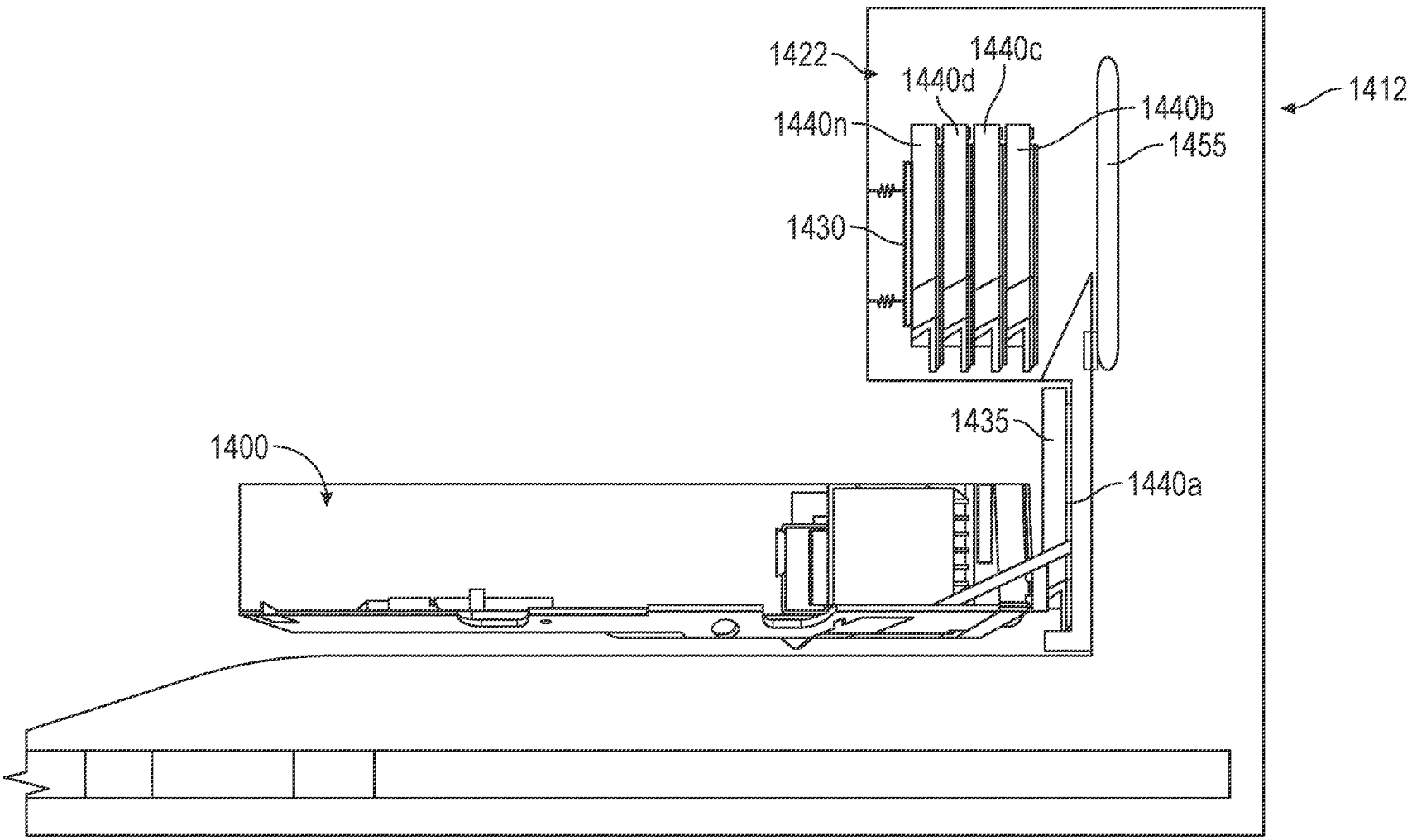
FIG. 14 illustrates a side view of a mobile cleaning robot and a docking station.

FIG. 14 illustrates a side view of a mobile cleaning robot 1400 and a docking station 1412. The mobile cleaning robot 1400 and docking station 1412 can be similar to those discussed above; the robot 1400 and docking station 1412 can differ in that the docking station 1412 can include a vertical conveyor pad changing system. Any of the robots and docking stations discussed above or below can be modified to include such a system.

More specifically, a conveyor or track 1455 of the docking station 1412 can be used to engage a pad 1440*a* connected to a tray 1435 of the robot 1400. The conveyor 1455 can move the soiled pad 1440*a* to a pad receptacle and disengage the soiled pad 1440*a*. The conveyor 1455 can then retrieve a clean pad 1440*b* from a pad shoe 1430 (biased toward the conveyor 1455) of a pad dispenser 1422. The retrieved clean pad 1440*b* can then be brought by the conveyor 1455 to the tray 1435 for attachment or connection to the tray 1435.

Figure 15:
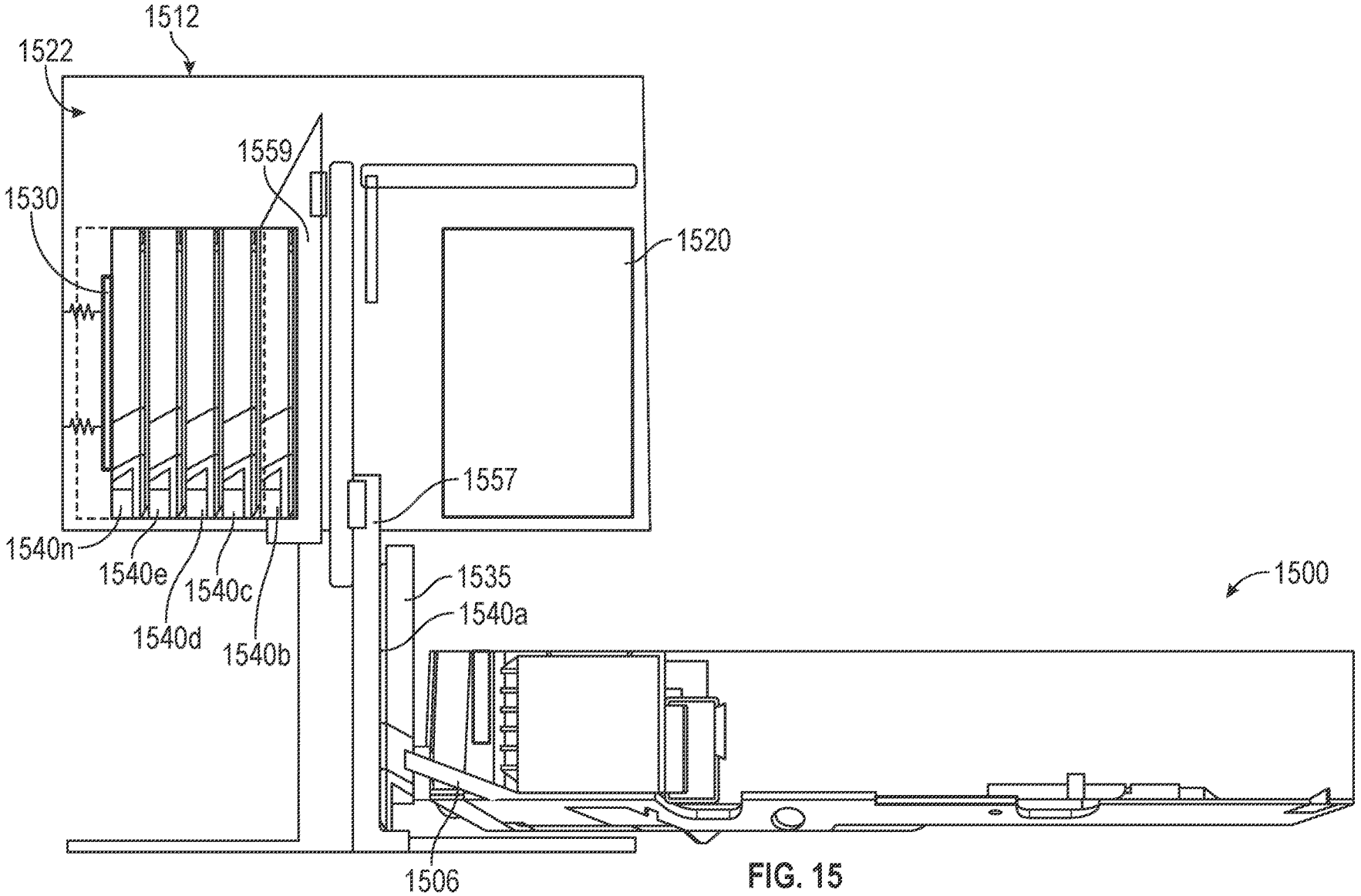
FIG. 15 illustrates a front view of a mobile cleaning robot and a docking station.

FIG. 15 illustrates a front view of a mobile cleaning robot 1500 and a docking station 1512. The mobile cleaning robot 1500 and docking station 1512 can be similar to those discussed above; the robot 1500 and docking station 1512 can differ in that the docking station 1512 can include a two-sided pad changing system. Any of the robots and docking stations discussed above or below can be modified to include such a system.

More specifically, a pad receptacle 1520 can be positioned on a first side of the docking station 1512 and a pad dispenser 1522 can be positioned on a second side of the docking station. A first conveyor or track 1557 of the docking station 1512 can retrieve a soiled pad 1540*a* from a tray 1535 connected to arms 1506 of the robot 1500. The robot 1500 can then navigate (e.g., autonomously) to the pad dispenser 1522 of the docking station 1512 where a second conveyor 1559 can deliver a fresh pad 1540*b* (of the pads 1540*b*-1540*n*) from a pad shoe 1530 of the pad dispenser 1522 to the tray 1535 of the robot 1500.

Figure 16:
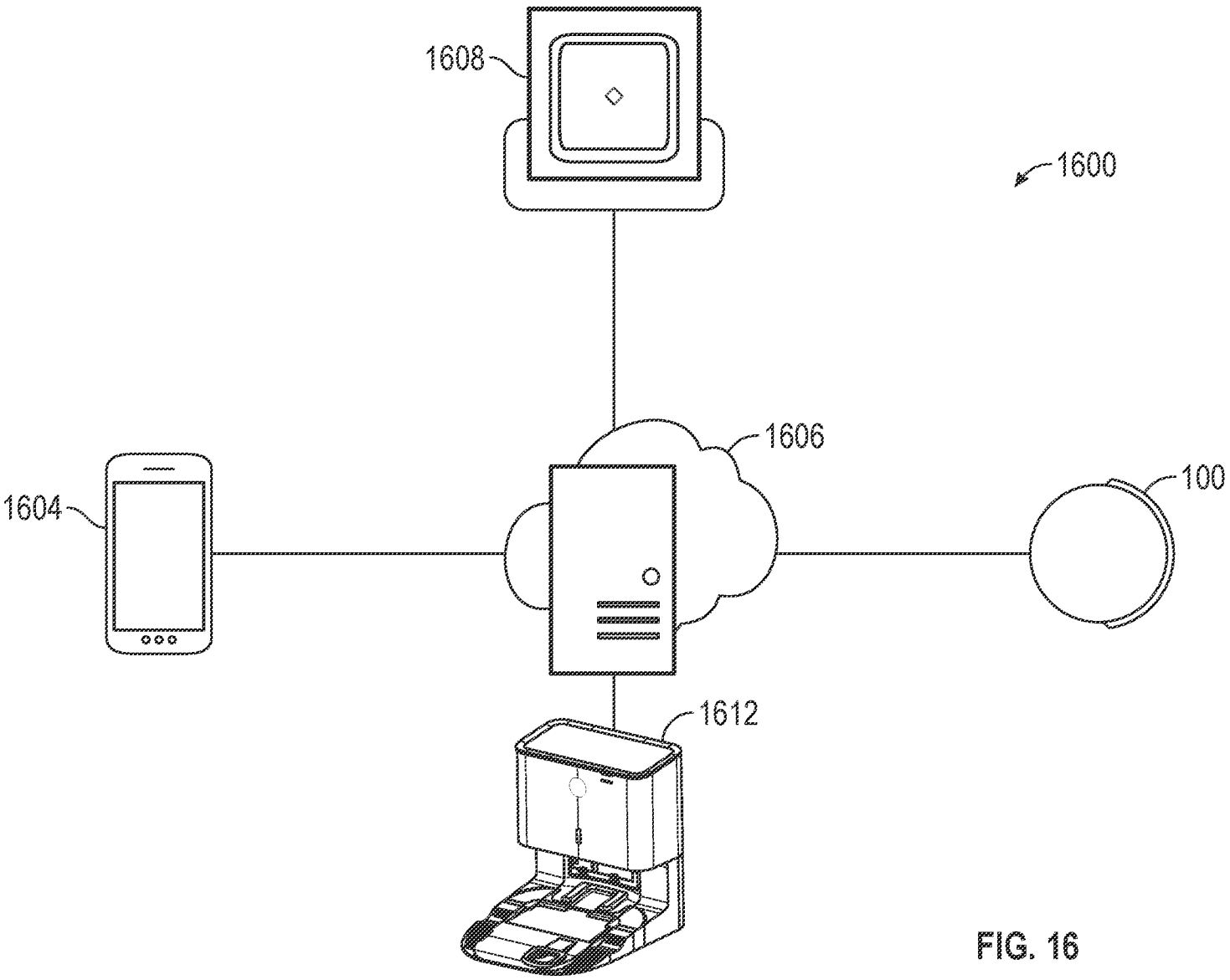
FIG. 16 illustrates a schematic view of a mobile cleaning robot network.

FIG. 16 illustrates a schematic view of a mobile cleaning robot network 1600 that enables networking between the mobile robot 100 and one or more other devices, such as a mobile device 1604, a cloud computing system 1606, another autonomous robot 1608 separate from the mobile robot 100, or a docking station 1612.

Using the communication network 1600, the robot 100, the mobile device 1604, the robot 1608, and the cloud computing system 1606 can communicate with one another to transmit and receive data from one another. In some examples, the robot 100, the docking station 1612, or both the robot 100 and the docking station 1612 communicate with the mobile device 1604 through the cloud computing system 1606. Alternatively, or additionally, the robot 100, the docking station 1612, or both the robot 100 and the docking station 1612 can communicate directly with the mobile device 1604. Various types and combinations of wireless networks (e.g., Bluetooth, radio frequency, optical based, etc.) and network architectures (e.g., point-to-point or mesh networks) can be employed by the communication network 1600.

In some examples, the mobile device 1604 can be a remote device that can be linked to the cloud computing system 1606 and can enable a user to provide inputs. The mobile device 1604 can include user input elements such as, for example, one or more of a touchscreen display, buttons, a microphone, a mouse, a keyboard, or other devices that respond to inputs provided by the user. The mobile device 1604 can also include immersive media (e.g., virtual reality) with which the user can interact to provide input. The mobile device 1604, in these examples, can be a virtual reality headset or a head-mounted display.

The user can provide inputs corresponding to commands for the mobile robot 100. In such cases, the mobile device 1604 can transmit a signal to the cloud computing system 1606 to cause the cloud computing system 1606 to transmit a command signal to the mobile robot 100. In some implementations, the mobile device 1604 can present augmented reality images. In some implementations, the mobile device 1604 can be a smart phone, a laptop computer, a tablet computing device, or other mobile device.

In some examples, the communication network 1600 can include additional nodes. For example, nodes of the communication network 1600 can include additional robots. Also, nodes of the communication network 1600 can include network-connected devices that can generate information about the environment 40. Such a network-connected device can include one or more sensors, such as an acoustic sensor, an image capture system, or other sensor generating signals, to detect characteristics of the environment 40 from which features can be extracted. Network-connected devices can also include home cameras, smart sensors, or the like.

In the communication network 1600, the wireless links can utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel, satellite band, or the like. In some examples, wireless links can include any cellular network standards used to communicate among mobile devices, including, but not limited to, standards that qualify as 1G, 2G, 3G, 4G, 5G, or the like. The network standards, if utilized, qualify as, for example, one or more generations of mobile telecommunication standards by fulfilling a specification or standards such as the specifications maintained by International Telecommunication Union. For example, the 4G standards can correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards can use various channel access methods, e.g., FDMA, TDMA, CDMA, or SDMA.

According to some examples discussed herein, a dispenser sensor can be included in the docking station 1612 and can be configured to produce a dispenser status indicator based on a detected dispenser state within of the shoe (e.g., the shoe 130). The controller of the robot 100 (or other device of the network 1600) can be configured to determine a number of fresh pads located within the shoe (e.g., 130) based on the detected dispenser state of the status indicator of the docking station (e.g., 1612). Such a calculation or determination can be used by one or more components of the network 1600, such as to produce an alert when the dispenser is out of fresh pads or to avoid returning to the docking station when the dispenser is out of fresh pads, or to produce an alert before a mission including mopping is started.

In another example, the docking station 1612 can include a receptacle sensor. For example, the sensor 126 can be connected to the housing 114 or the bin 124 and can be configured to produce a signal or indicator based on a detected pad fill state within the pad receptacle, such as based on contents of the bin 124. The sensor 126 can be a pressure sensor, optical sensor, or the like. The controller of the robot 100, the docking station 1612, or another controller can in communication with the mobile cleaning robot and the receptacle fill status sensor 126, such that the controller can be configured to determine a number of pads located within the pad receptacle based on the receptacle fill status indicator. Such a calculation or determination can be used by one or more components of the network 1600, such as to produce an alert when the receptacle is full of soiled pads or to avoid returning to the docking station when the receptacle is full of soiled pads, or to produce an alert before a mission including mopping is started.

A controller of any of the devices discussed herein can be used to perform any of the functions or operations discussed herein, such as of the robots (e.g., 100), the docking stations (e.g., 112), or any other operated component.

Figure 17:
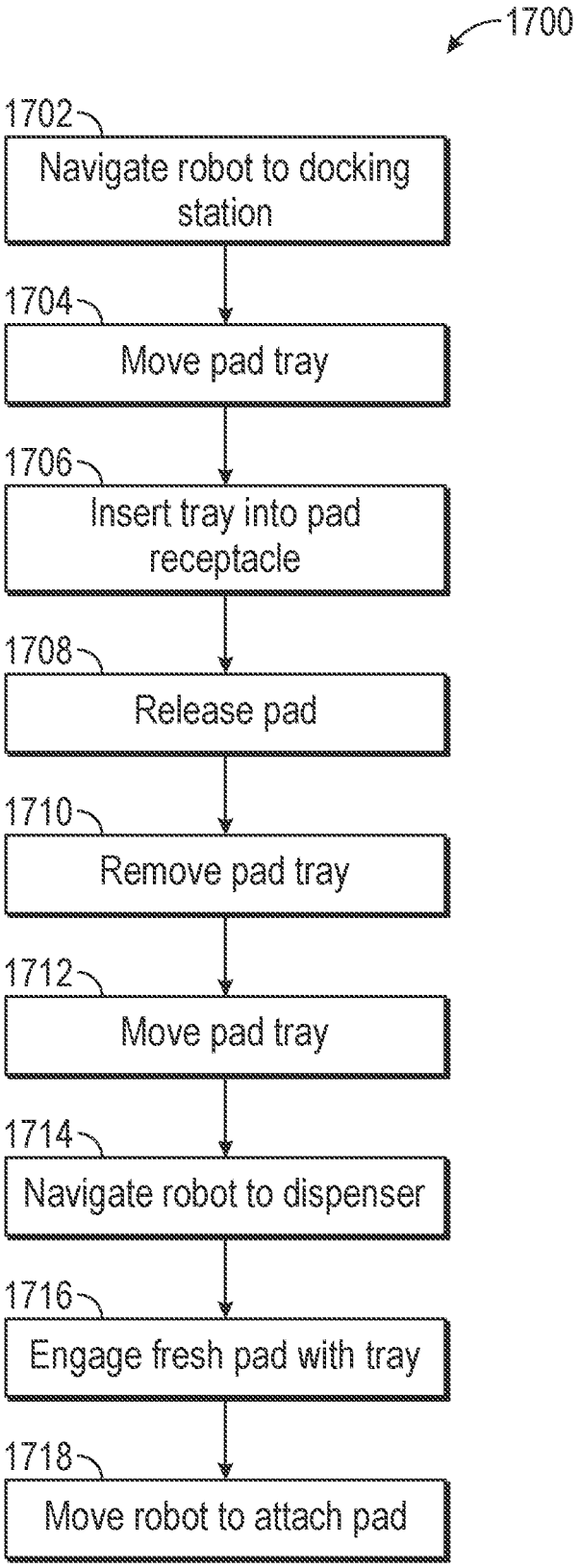
FIG. 17 illustrates a schematic view of a method of operating a mobile cleaning robot.

FIG. 17 illustrates a schematic view of the method 1700. The method 1700 can be a method of operating a mobile cleaning robot to change a mopping pad of the mobile cleaning robot using a docking station. More specific examples of the method 1700 are discussed below. The steps or operations of the method 1700 are illustrated in a particular order for convenience and clarity; many of the discussed operations can be performed in a different sequence or in parallel without materially impacting other operations. The method 1700 as discussed includes operations performed by multiple different actors, devices, and/or systems. It is understood that subsets of the operations discussed in the method 1700 can be attributable to a single actor, device, or system could be considered a separate standalone process or method.

The method 1700 can begin at step 1702 where a mobile cleaning robot can be navigated to a docking station. For example, the mobile cleaning robot 100 can be navigated to the docking station 1112. At step 1704 a pad tray of the mobile cleaning robot can be moved to a disposal position. For example, the pad tray 135 of the robot 100 can be moved to a disposal position. At step 1706, the mobile cleaning robot can be navigated or moved to insert the pad tray into a pad receptacle of the docking station. For example, the mobile cleaning robot 100 can be navigated or moved to insert the pad tray 135 into a pad receptacle of the docking station 112.

At step 1708 a mopping pad can be released from the pad tray into the pad receptacle. For example, the mopping pad assembly 140 can be released from the pad tray 135 into the pad receptacle 120. Optionally, releasing the mopping pad from the pad tray into the pad receptacle can include navigating the mobile cleaning robot to cause a release button of the pad tray to engage a release post of the docking station.

At step 1710 the mobile cleaning robot can be navigated to remove the pad tray from the pad receptacle of the docking station. For example, the mobile cleaning robot 1000 can be navigated to remove the pad tray 135 from the pad receptacle 120 of the docking station 112.

At step 1712, the pad tray can be moved to a retrieval position. For example, the robot 100 can move the pad tray 135 of the pad plate assembly 108 to a retrieval position (e.g., by extending arms 106). At step 1714, the mobile cleaning robot can be navigated to a pad dispenser. For example, the mobile cleaning robot 100 can be navigated or moved to the pad dispenser 122 (such as to the pad shoe 130). At step 1716, a fresh pad can be engaged with the pad tray. For example, the pad assembly 140 can be engaged with the pad tray 135 of the pad plate assembly 108. At step 1718, the mobile cleaning robot can be moved to cause attachment between the fresh pad and the fresh tray. For example, the robot 100 can be moved (such as autonomously) to effect connection between the pad assembly 140 and the tray 135. For example, the robot 100 can wiggle or shake to obtain alignment between the magnet 152 and the plate 148 and to align the mating features 146 of the pad assembly 140 with the recesses of the tray 135.

NOTES AND EXAMPLES

The following, non-limiting examples, detail certain aspects of the present subject matter to solve the challenges and provide the benefits discussed herein, among others.

Example 1 is a docking station for a mobile cleaning robot, the docking station comprising: a housing, at least one of defining or comprising: a pad receptacle configured to receive a soiled pad from a pad tray of the mobile cleaning robot; and a pad dispenser configured to provide a fresh pad to the pad tray of the mobile cleaning robot.

In Example 2, the subject matter of Example 1 optionally includes a receptacle fill sensor connected to the housing and configured to produce a receptacle fill status indicator based on a detected pad fill state within the pad receptacle.

In Example 3, the subject matter of Example 2 optionally includes a controller in communication with the mobile cleaning robot and the receptacle fill status sensor, the controller configured to determine a number of pads located within the pad receptacle based on the receptacle fill status indicator.

In Example 4, the subject matter of Example 3 optionally includes wherein the pad dispenser includes a shoe configured to support the fresh pad, the shoe biased toward an access side of the docking station.

In Example 5, the subject matter of Example 4 optionally includes a dispenser sensor connected to the housing and configured to produce a dispenser status indicator based on a detected dispenser state of the shoe, wherein the controller is configured to determine a number of fresh pads located within the shoe based on the dispenser status indicator.

In Example 6, the subject matter of any one or more of Examples 4-5 optionally include wherein the shoe is angled to be offset with respect to a vertical direction of a gravitational force.

In Example 7, the subject matter of any one or more of Examples 1-6 optionally include a rib located at or near the pad receptacle, the rib engageable with the pad tray to release the soiled pad from the pad tray.

Example 8 is a mobile cleaning robot comprising: a mobile cleaning robot comprising: a body; a drive system connected to the body and operable to move the mobile cleaning robot about a floor surface; a link connected to the body and movable with respect to the body; and a pad tray connected to the link, the pad tray configured to support a mopping pad engageable with the floor surface, the pad tray including a pad release actuator engageable with a docking station to release the mopping pad from the pad tray.

In Example 9, the subject matter of Example 8 optionally includes a magnet included in or connected to the actuator and moveable therewith, the magnet engageable with a magnetically-attractable first portion of the pad to retain the pad on the pad tray.

In Example 10, the subject matter of Example 9 optionally includes wherein the pad tray includes a body, the actuator being translatable relative to the body.

In Example 11, the subject matter of Example 10 optionally includes wherein the body includes a wing magnet located at a forward portion of the pad tray, the wing magnet engageable with a second magnetically-attractable second portion of the pad to retain the pad on the pad tray.

In Example 12, the subject matter of Example 11 optionally includes wherein the body includes a recess configured to receive, at least partially, therein a projection of the mopping pad to orient the mopping pad such that the magnet magnetically engages the magnetically attractable first portion of the pad and the wing magnet magnetically engages the magnetically-attractable second portion of the pad.

In Example 13, the subject matter of Example 12 optionally includes wherein the magnet has a magnetic field strong enough to move the pad at a first distance less than a height of the projection and not strong enough to move the pad at a second distance greater than the height of the projection.

In Example 14, the subject matter of any one or more of Examples 9-13 optionally include wherein the magnet is a multipole magnet.

Example 15 is a mobile cleaning robot system comprising: a mobile cleaning robot comprising: a body; a drive system connected to the body and operable to move the mobile cleaning robot about a floor surface; a pad tray configured to support a mopping pad engageable with the floor surface; and a link connected to the mopping pad assembly and the body; and a docking station comprising: a housing defined at least in part by a plurality of walls; a pad receptacle configured to receive a soiled pad from the pad tray; and a pad dispenser configured to deliver a fresh pad to the pad tray.

In Example 16, the subject matter of Example 15 optionally includes a receptacle fill sensor connected to the housing and configured to produce a receptacle fill status indicator based on a detected pad fill state within the pad receptacle.

In Example 17, the subject matter of Example 16 optionally includes a controller in communication with the mobile cleaning robot and the receptacle fill status sensor, the controller configured to determine a number of pads located within the pad receptacle based on the receptacle fill status indicator.

In Example 18, the subject matter of Example 17 optionally includes wherein the pad dispenser includes a shoe configured to support the fresh pad, the shoe biased toward an access side of the docking station.

In Example 19, the subject matter of Example 18 optionally includes a dispenser sensor connected to the housing and configured to produce a dispenser status indicator based on a detected dispenser state within of the shoe, wherein the controller is configured to determine a number of fresh pads located within the shoe based on the dispenser status indicator.

In Example 20, the subject matter of any one or more of Examples 15-19 optionally include wherein the pad tray includes a pad release actuator engageable with a docking station to release the mopping pad from the pad tray.

In Example 21, the subject matter of Example 20 optionally includes a magnet included in or connected to the actuator and moveable therewith, the magnet engageable with a magnetically-attractable first portion of the pad to retain the pad on the pad tray.

In Example 22, the subject matter of Example 21 optionally includes wherein the pad tray includes a body, the actuator being translatable relative to the body.

In Example 23, the subject matter of Example 22 optionally includes wherein the body includes a wing magnet located at a forward portion of the pad tray, the wing magnet engageable with a second magnetically-attractable second portion of the pad to retain the pad on the pad tray.

In Example 24, the subject matter of Example 23 optionally includes wherein the body includes a recess configured to receive, at least partially, therein a projection of the mopping pad to orient the mopping pad such that the magnet magnetically engages the magnetically attractable first portion of the pad and the wing magnet magnetically engages the magnetically-attractable second portion of the pad.

Example 25 is a method of changing a mopping pad of a mobile cleaning robot using a docking station, the method comprising: navigating the mobile cleaning robot to the docking station; releasing a mopping pad from the pad tray into a pad receptacle of the docking station; engaging a fresh pad with the pad tray; moving the mobile cleaning robot to cause attachment between the fresh pad and the fresh tray.

In Example 26, the subject matter of Example 25 optionally includes moving the pad tray of the mobile cleaning robot to a disposal position; navigating the mobile cleaning robot to insert the pad tray into the pad receptacle.

In Example 27, the subject matter of Example 26 optionally includes navigating the mobile cleaning robot to remove the pad tray from the pad receptacle of the docking station; moving the pad tray to a retrieval position; and navigating the mobile cleaning robot to a pad dispenser of the docking station.

In Example 28, the subject matter of Example 27 optionally includes wherein releasing the mopping pad from the pad tray into the pad receptacle includes navigating the mobile cleaning robot to cause a release button of the pad tray to engage a release post of the docking station.

In Example 29, the apparatuses or method of any one or any combination of Examples 1-23 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A docking station for a mobile cleaning robot, the docking station comprising:

a housing, at least one of defining or comprising:

a pad receptacle configured to receive a soiled pad from a pad tray of the mobile cleaning robot;

an opening extending through at least a portion of a side of the housing; and a pad dispenser configured to provide a fresh pad to the pad tray of the mobile cleaning robot through the opening, the pad dispenser including a shoe configured to support the fresh pad, the shoe biased toward the opening and the side of the docking station; and a receptacle fill sensor connected to the housing and configured to produce a receptacle fill status indicator based on a detected pad fill state within the pad receptacle.

2. The docking station of claim 1, further comprising:

a controller in communication with the mobile cleaning robot and the receptacle fill status sensor, the controller configured to determine a number of pads located within the pad receptacle based on the receptacle fill status indicator.

3. The docking station of claim 2, further comprising:

a dispenser sensor connected to the housing and configured to produce a dispenser status indicator based on a detected dispenser state of the shoe, wherein the controller is configured to determine a number of fresh pads located within the shoe based on the dispenser status indicator.

4. The docking station of claim 1, wherein the shoe is angled to be offset with respect to a vertical direction of a gravitational force.

5. The docking station of claim 1, further comprising:

a rib located at or near the pad receptacle, the rib engageable with the pad tray to release the soiled pad from the pad tray.

6. A mobile cleaning robot comprising:

a body;

a drive system connected to the body and operable to move the mobile cleaning robot about a floor surface; and a pad tray configured to support a mopping pad engageable with the floor surface, the pad tray including a pad release actuator engageable with a docking station to release the mopping pad from the pad tray;

a link connected to the body and movable with respect to the body to move the pad tray between a cleaning position under the body and a stored position above a top portion of the body.

7. The mobile cleaning robot of claim 6, further comprising:

a magnet included in or connected to the actuator and moveable therewith, the magnet engageable with a magnetically-attractable first portion of the pad to retain the pad on the pad tray.

8. The mobile cleaning robot of claim 7, wherein the pad tray includes a body, the actuator being translatable relative to the body.

9. The mobile cleaning robot of claim 8, wherein the body of the pad tray includes a wing magnet located at a forward portion of the pad tray, the wing magnet engageable with a second magnetically-attractable second portion of the pad to retain the pad on the pad tray.

10. The mobile cleaning robot of claim 9, wherein the body of the pad tray includes a recess configured to receive, at least partially, therein a projection of the mopping pad to orient the mopping pad such that the magnet magnetically engages the magnetically-attractable first portion of the pad and the wing magnet magnetically engages the magnetically-attractable second portion of the pad.

11. The mobile cleaning robot of claim 10, wherein the magnet has a magnetic field strong enough to move the pad at a first distance less than a height of the projection and not strong enough to move the pad at a second distance greater than the height of the projection.

12. The mobile cleaning robot of claim 7, wherein the magnet is a multipole magnet.

13. A mobile cleaning robot system comprising:

a mobile cleaning robot comprising:

a body;

a drive system connected to the body and operable to move the mobile cleaning robot about a floor surface;

a pad tray configured to support a mopping pad engageable with the floor surface; and a link connected to the mopping pad and the body; and a docking station comprising:

a housing defined at least in part by a plurality of walls including a side wall defining an opening extending through at least a portion of a side of the housing;

a pad receptacle configured to receive a soiled pad from the pad tray;

a pad dispenser configured to deliver a fresh pad to the pad tray through the opening of the side wall, the pad dispenser including a shoe configured to support the fresh pad, the shoe biased toward the opening and the side of the docking station; and a receptacle fill sensor connected to the housing and configured to produce a receptacle fill status indicator based on a detected pad fill state within the pad receptacle.

14. The system of claim 13, further comprising:

a controller in communication with the mobile cleaning robot and the receptacle fill status sensor, the controller configured to determine a number of pads located within the pad receptacle based on the receptacle fill status indicator.

15. The system of claim 14, further comprising:

a dispenser sensor connected to the housing and configured to produce a dispenser status indicator based on a detected dispenser state within of the shoe, wherein the controller is configured to determine a number of fresh pads located within the shoe based on the dispenser status indicator.

16. The system of claim 13, wherein the pad tray includes a pad release actuator engageable with the docking station to release the mopping pad from the pad tray.

17. The system of claim 16, further comprising:

a magnet included in or connected to the actuator and moveable therewith, the magnet engageable with a magnetically-attractable first portion of the pad to retain the pad on the pad tray.

18. The system of claim 17, wherein the pad tray includes a body, the actuator being translatable relative to the body of the pad tray.

19. The system of claim 18, wherein the body of the pad tray includes a wing magnet located at a forward portion of the pad tray, the wing magnet engageable with a second magnetically-attractable second portion of the pad to retain the pad on the pad tray.

20. The system of claim 19, wherein the body of the pad tray includes a recess configured to receive, at least partially, therein a projection of the mopping pad to orient the mopping pad such that the magnet magnetically engages the magnetically-attractable first portion of the pad and the wing magnet magnetically engages the magnetically-attractable second portion of the pad.

* * * * *